US007409807B2

(12) United States Patent
Russell

(10) Patent No.: US 7,409,807 B2
(45) Date of Patent: Aug. 12, 2008

(54) METHODS AND APPARATUS FOR FORMING AND PLACING GENERALLY HORIZONTAL STRUCTURES

(76) Inventor: Matthew Russell, 4408 W. Elderberry St., Spokane, WA (US) 99208

( * ) Notice: Subject to any disclaimer, the term of this patent is extended or adjusted under 35 U.S.C. 154(b) by 0 days.

(21) Appl. No.: 11/811,803

(22) Filed: Jun. 12, 2007

(65) Prior Publication Data

US 2007/0234680 A1 Oct. 11, 2007

Related U.S. Application Data

(62) Division of application No. 10/967,798, filed on Oct. 18, 2004, now Pat. No. 7,243,474, which is a division of application No. 10/346,370, filed on Jan. 18, 2003, now Pat. No. 6,832,459.

(60) Provisional application No. 60/349,545, filed on Jan. 18, 2002, provisional application No. 60/381,536, filed on May 17, 2002.

(51) Int. Cl.
*E04B 1/00* (2006.01)
*E04G 21/00* (2006.01)
*E04G 23/00* (2006.01)

(52) U.S. Cl. ..... 52/745.11; 52/745.2; 52/745.09

(58) Field of Classification Search ..... 52/745.05, 52/745.11, 745.19, 745.14, 745.2, 745.09, 52/116; 249/19, 20, 22, 24, 33, 36; 212/177, 212/300

See application file for complete search history.

(56) References Cited

U.S. PATENT DOCUMENTS 6,832,459 B2 * 12/2004 Russell ..... 52/745.05
7,243,474 B2 * 7/2007 Russell ..... 52/45.11

* cited by examiner

*Primary Examiner*—Richard E. Chilcot, Jr.
*Assistant Examiner*—Chi Q Nguyen
(74) *Attorney, Agent, or Firm*—John S. Reid; Gregory IPL, P.C.

(57) ABSTRACT

One embodiment of the present invention provides for a method of placing a concrete structure in a generally horizontal position. The method includes building the concrete structure in an essentially vertical position, the concrete structure being defined by a first end. The concrete structure is pivotably supported at a support location proximate the first end while the concrete structure is in the essentially vertical position. The concrete structure is then pivoted about the support location to move the concrete structure from the essentially vertical position to the generally horizontal position.

5 Claims, 16 Drawing Sheets

METHODS AND APPARATUS FOR FORMING AND PLACING GENERALLY HORIZONTAL STRUCTURES

CROSS REFERENCE TO RELATED APPLICATIONS

This application is a divisional application under 35 U.S.C. § 121 of U.S. patent application Ser. No. 10/967,798 now U.S. Pat. No. 7,243,474, filed Oct. 18, 2004 and entitled "Methods And Apparatus For Forming And Placing Generally Horizontal Structures", which is a divisional application under 35 U.S.C. § 121 of U.S. patent application Ser. No. 10/346,370 (now U.S. Pat. No. 6,832,459), filed Jan. 18, 2003 and entitled "Methods And Apparatus For Forming And Placing Generally Horizontal Structures", which in turn claims priority under 35 U.S.C. § 120 to U.S. Provisional Patent Application Ser. No. 60/349,545, filed Jan. 18, 2002 and entitled, "Vertical Casting or Vertical Assembly Method of Construction for Bridge Spans", as well as U.S. Provisional Patent Application Ser. No. 60/381,536, filed May. 17, 2002 and entitled, "Methods and Apparatus for Lowering Vertically Cast Bridge Spans and the Like", all of which are hereby incorporated herein by reference in their entirety.

FIELD OF THE INVENTION

The invention claimed and disclosed herein pertains to apparatus and methods for forming concrete structures, and in particular to methods and apparatus for forming vertical or near-vertical concrete structures and thereafter placing them in non-vertical positions.

BACKGROUND OF THE INVENTION

This invention pertains to methods and apparatus for constructing non-vertically oriented concrete structures. By "non-vertically oriented" I mean that the structure is generally oriented at an angle of between zero degrees and sixty degrees from horizontal, although there is no precise upper limit on the angle with respect to the horizontal except that it is generally less than ninety degrees from horizontal.

Non-limiting examples of non-vertical structures include bridge spans, large beams or transfer girders for applications such as building frames and offset bridges, conveyor galleries, and conduits, either buried or aboveground or elevated such as pipelines and other duct ways.

A universal theme in constructing non-vertical structures, and bridge spans in particular, is that as the bridge spans are constructed or assembled, they progressively take the final design shape of the bridge. There are many ways this construct-in-place or assemble-in-place theme is accomplished: (1) the bridge spans can be constructed in stages on false work beams and bents, as is the case with most cast-in-place post tensioned highway bridges (an example is the standard cast-in-place post-tensioned box girder bridge); (2) steel or precast beams or girders can be set between bents or piers, and then spanned with steel decking or a form soffet between these beams or girders, and a concrete deck is then cast that is composite with the beams or girders (this method is commonly referred to as "composite bridge construction"); (3) whole bridge sections are assembled into a large portion of a span or a whole span and are then transported to a job site and set on support piers or bents (an example of this method is construction of a steel trestle bridge across a river, the sections of which are put in place by barge cranes); (4) precast or cast-in-place sections are progressively cantilevered off of a pier support through bending rigidity and/or support links such as cables from a tower until a complete span is achieved at an abutment or by meeting a span that also may be cantilevered off of a distantly adjacent pier (examples are concrete box girder viaduct construction as well as cable-stayed bridges); (5) suspension bridge construction; and (6) floating bridge construction.

There are a number of shortcomings with the prior art. Firstly, as concerns the achievement of the universal theme of constructing and/or assembling a bridge in its final orientation, in virtually all examples of construction described above, the means of temporary support such as false-work or the support equipment such as crane barges inherently constricts or blocks the very avenue the bridge is being constructed to cross over for the majority of the duration of the construction project. For example, false-work constricts freeways for months during construction. Secondly, the labor pool involved in construction of bridges and the like inherently has to travel to the work rather than work coming to the worker (i.e., a finished bridge is not delivered to a worksite for installation, but is constructed at the installation site). Geographically the area of construction activities for non-vertical structures is much greater and more dispersed than for vertically oriented structures (such as a building, for example), which requires more access ways and equipment such as cranes, and more equipment moves. Further, there are a significant number of varied activities associated with the prior art approaches to constructing non-vertical structures, which require more and varied supervision and a broader set of learning curves for persons working on the construction job, all of which are expensive and time consuming.

A further reason that such non-vertical structures are typically built-in-place is that the shear mass of modular pieces of precast concrete, and the massive mechanical means required to get them to an assembly point on a bridge span, generally precludes the use of very large precast units. It also makes it necessary to repeat very time consuming and precise fit-up activities as well as to replicate expensive connection details quite frequently along the length of the span. Accordingly, most bridges include conventionally-formed cast-in-place concrete sections. The forming and casting process tends to be very labor intensive, involving a significant number of skilled laborers such as carpenters and ironworkers.

SUMMARY OF THE INVENTION

One embodiment of the present invention provides for a method of placing a concrete structure in a generally horizontal position. The method includes building the concrete structure in an essentially vertical position, the concrete structure being defined by a first end. The concrete structure is pivotably supported at a support location proximate the first end while the concrete structure is in the essentially vertical position. The concrete structure is then pivoted about the support location to move the concrete structure from the essentially vertical position to the generally horizontal position.

Another embodiment of the invention provides for a structure lowering apparatus which can be used to lower a concrete structure from an essentially vertical position to a generally horizontal position. The concrete structure is defined by a first end and an opposite second end, and the concrete structure is pivotably supported at a first support location proximate the first end. The concrete structure is intended to be supported at the second end by a second support when the concrete structure is in the generally horizontal position. The apparatus includes a boom defined by a boom first end and a boom second end. The boom is configured to be pivotably supported by the second support at the boom first end. The apparatus further includes a lowering jack which engages and is configured to move along the boom, and which is configured to be pivotably attached to the second end of the concrete structure.

Yet another embodiment of the present invention provides for a method of placing a concrete structure in a generally horizontal position. The method includes providing a first support and a second support, and providing the concrete structure. The concrete structure is defined by a structure first end and an opposite structure second end. The method further includes pivotably supporting the concrete structure on the first support proximate the structure first end and in an essentially vertical position. A boom is provided, the boom being defined by a boom first end and a boom second end. The boom first end is pivotably supported on the second support, and the boom second end is moveably connected to the concrete structure proximate the structure second end. The structure second end is then moved along the boom towards the second support until the concrete structure is in the generally horizontal position.

These and other aspects and embodiments of the present invention will now be described in detail with reference to the accompanying drawings, wherein:

DETAILED DESCRIPTION OF THE INVENTION

The present invention provides for methods and apparatus for constructing vertical and near-vertical concrete structures, and then rotating or pivoting them into final position to act as a non-vertical structure. This results in a non-vertical structure, such as a bridge span, that is more economical to construct and takes significantly less time to construct over prior art methods of constructing non-vertical structures. The structure can be formed in the vertical or near-vertical position using known forming and casting methods and apparatus. Preferably, however, the structure is formed in the vertical or near-vertical position using the apparatus described in my U.S. patent application Ser. No. 10/131,838 entitled, "Methods and Apparatus for Forming Concrete Structures", and/or my U.S. patent application Ser. No. 10/166,406, entitled, "Methods And Apparatus For Building Tall Vertical Structures", both of which are hereby incorporated herein by reference in their entirety.

Embodiments of the present invention allow for the construction of bridge spans and the like at reduced cost and time of construction over prior art methods. Further, the work-site for constructing non-vertical structures in accordance with the present invention is relatively compact as compared to the size of a work site required when prior art methods are used. The compactness of the worksite when the methods of construction of the present invention are used results in savings in cranage and crane moves, the requirements of which are much more numerous for a horizontally distributed project constructed in accordance with prior art methods. For example, the present invention allows for a single tower crane to supply one vertically traveling casting deck (as will be described more fully below), which is more efficient than using many cranes distributed about a large span being cast or assembled horizontally in accordance with prior art methods. Additionally, since it is inherent in the methods of the current invention that the direction of construction (vertical or near vertical) is generally orthonormal to the eventual span direction, the work inherently does not interfere with the traffic (ship, auto, etc.) over which the bridge or structure is intended to eventually span. As a comparison, in a typical prior art bridge construction project performed conventionally over active traffic, lanes of traffic have to be narrowed and false work installed during construction, thus restricting the flow of traffic and increasing the cost and time of construction.

Figure 9:
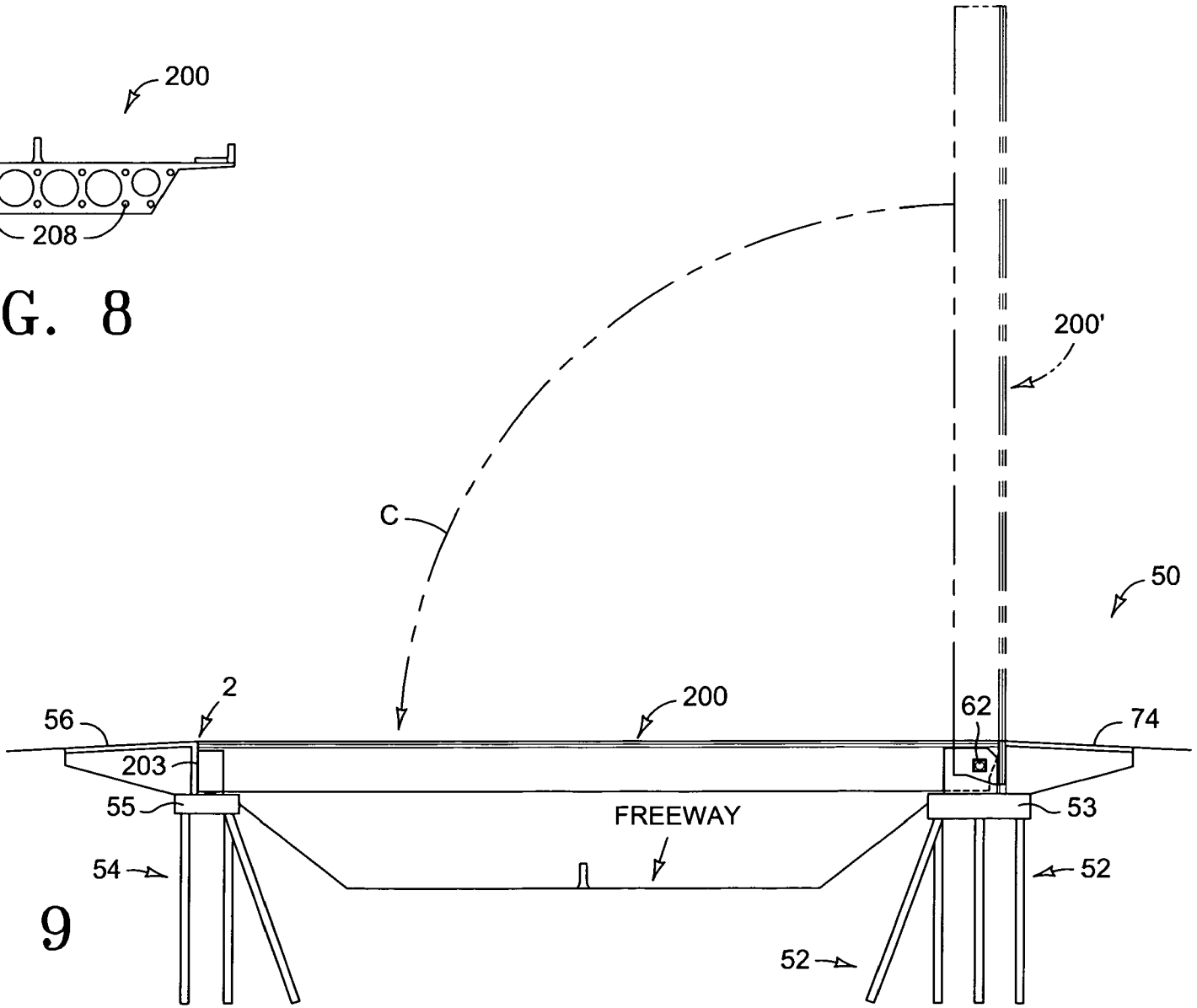
FIG. 9 is a front view depicting the vertically formed structure crossing the span depicted in FIG. 6.
Figure 10:
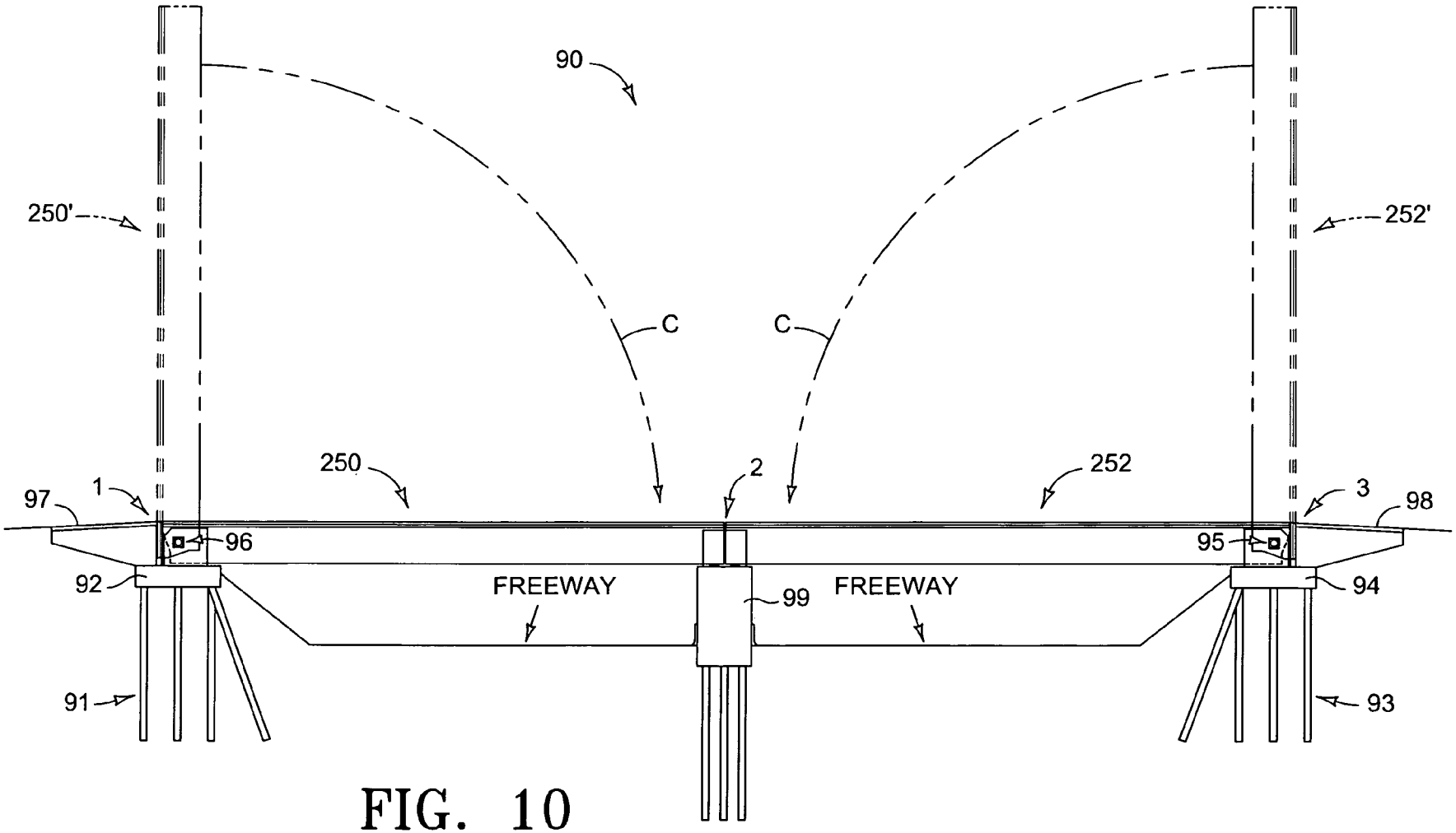
FIG. 10 is a front view depicting another span across a freeway, and two vertically formed structures which are intended to be placed across the span.
Figure 11:
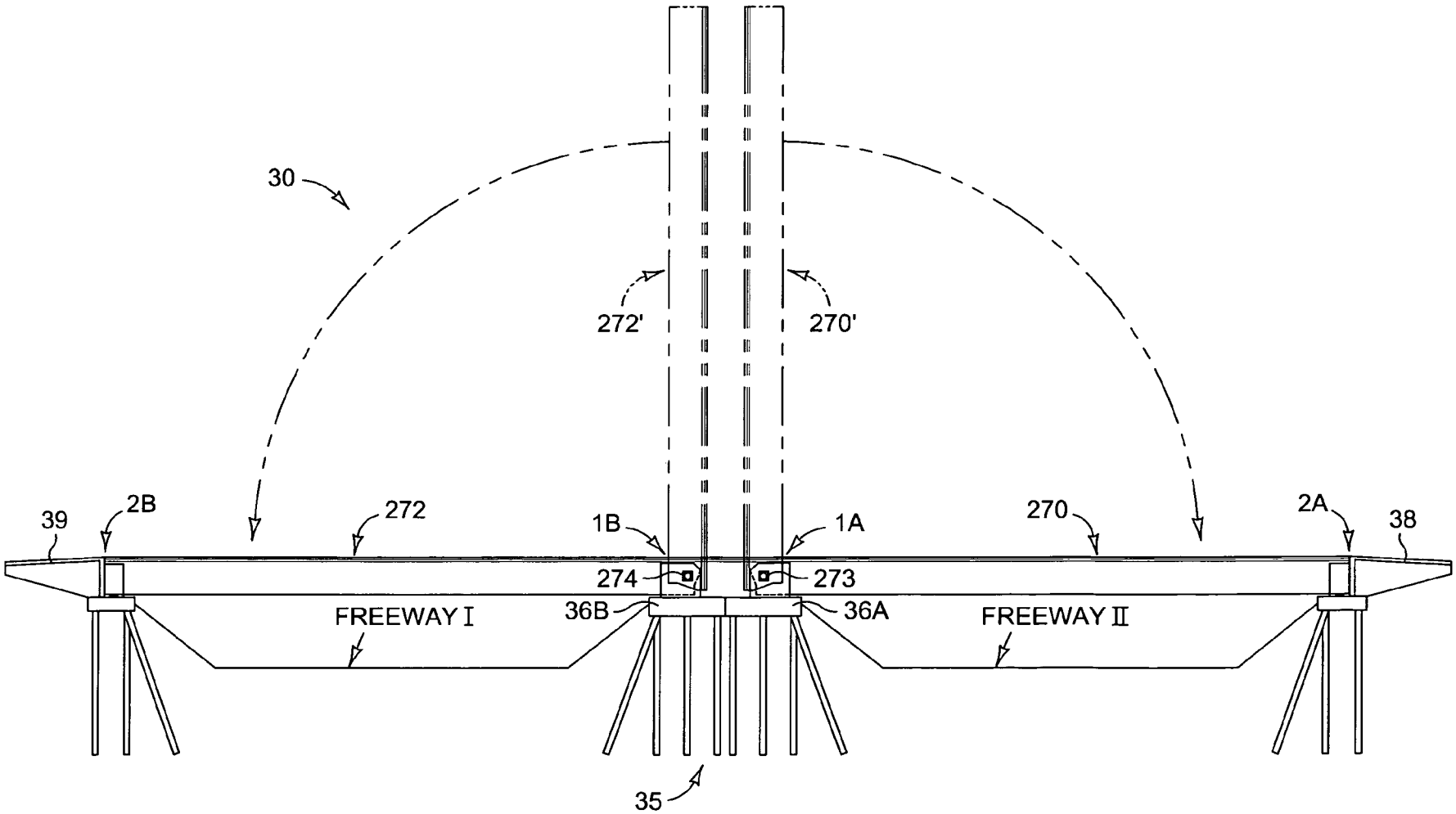
FIG. 11 is a front view depicting yet another span across a freeway, and two vertically formed structures which are intended to be placed across the span.

Methods of the present invention are applicable to virtually any span lengths and support types. The method is applicable to bridge and girder spans, as well as to other non-vertical structures, as previously mentioned. However, for purposes of providing one example of the present invention, the drawings will be directed to the following three different constructs of box-girder type bridges: (1) an off-center cantilever trestle type span over water (FIGS. 1 through 5); (2) a simple freeway overp-crossing span (FIGS. 6 through 9 and FIGS. 12 and 14 through 19); and (3) complex freeway over-crossings using a common central joining or pivot location (FIGS. 10 and 11).

As stated previously, in methods of the present invention a non-vertical structure is generated by first forming a vertical or near-vertical concrete structure, and then pivoting or rotating the vertical or near-vertical structure into the non-vertical position to be ultimately occupied by the structure. As also stated earlier, the concrete structure can be formed in the vertical or near-vertical position using classical concrete forming techniques. However, a preferred method of forming the vertical or near vertical concrete structures is to use an apparatus such as described in my U.S. patent application Ser. No. 10/131,838 ("Methods and Apparatus for Forming Concrete Structures") and/or an apparatus such as described in my U.S. patent application Ser. No. 10/166,406 ("Methods and Apparatus for Building Tall Vertical Structures"), both of which are hereby incorporated herein by reference in their entirety. The apparatus described in the referenced patent applications is referred to in those applications as a "jump-slip machine" due to the ability of the apparatus to form vertical structures in a slip forming mode or a jump forming mode. I will refer to that apparatus herein as a "vertical casting apparatus", although it will be appreciated that the apparatus can also perform near-vertical casting of concrete structures.

In the following discussion, I will use the term "vertical" to mean both true vertical and near-vertical, unless indicated otherwise. "Near vertical" means that segments or whole structures can be purposely constructed at a slope or out-of-plumb (not to be confused with construction plumbness tolerances), tapered (so an inside or outside surface is not plumb), or curved in vertical section (to provide vertical or horizontal bridge curvature.) Similarly, I will use the term "horizontal" to mean both true horizontal and near-horizontal, unless indicated otherwise. Accordingly, the expression "vertical casting" of a bridge span or other structure intended to be ultimately placed in a horizontal position is generally defined herein as forming a length of bridge span, either in full or in part, in a direction parallel to or closely parallel to and in the opposite direction or closely opposite direction of the gravitational pull of the earth. Further, as used herein the expression "essentially vertical" shall mean true vertical and near vertical (and not horizontal or near horizontal), and "generally horizontal" shall mean non-vertical (that is, not "vertical" or "near vertical"). Therefore, the present invention provides methods and apparatus for forming a structure in an essentially vertical position, and subsequently rotating the structure to a final generally horizontal position. It will however be appreciated that in addition to rotational movement of the structure, some accompanied translational movement of the structure (e.g., vertically and/or horizontally) can be utilized to facilitate the lowering of the structure to its final position. For example, a bridge span can be constructed vertically to one side of an intended abutment, then moved translationally to be in-line with the roadway, after which it can be lower by rotation.

A complete bridge span or section of a bridge span can be constructed by casting discrete lifts (jump forming) or casting in a continuous fashion (slip forming) until the span length or partial span length is achieved. As used herein, "closed-form structures" and "closed form spans" means those structures or spans of a bridge or the like where, when viewed in cross section, the span is defined by sides that form a closed shape that encloses an area. Closed-form structures can be made up of many chambers, a chamber being defined as a portion of the closed-form which itself encloses an area. Openings in a close-form structure do not necessarily preclude the structure from being a closed-form structure. As used herein, "open-form structure", "open-form span", "open-form span section" and "open-form footprints" include structures, spans, sections and footprints where, when viewed in cross section, the entity is defined by walls that do not enclose an area. A "combination form section" of a span or structure or the like is a section defined by walls that include both closed-form and open-form sections. A "solid span section" is essentially a subset of an "open-form section" in that it does not enclose an area. A solid span section is more specifically defined as having a specific solid geometry, such as a rectangle or square, and are not long, thin, and shell-like in structure. A "semi-solid section" means that the section includes block-outs applied between casting form faces within the interior of the span section to make continuous or discrete voids or cells, which is typically done to reduce the weight of the span.

As used herein, "reinforced concrete" includes what is generally known in the construction industry as "reinforced Portland Cement Concrete", and as given design guidance for by the American Concrete Institute ("ACI"), the Portland Cement Association ("PCA"), The Uniform Building Code ("UBC"), the American Society of Highway and Transportation Officials ("ASHTO"), the International Standards Organization ("ISO"), and by other applicable codes. The definition of "reinforced concrete" is also to be general enough to include High Strength Portland Cement Concretes, Light Weight Portland Cement Concretes, Fiber Reinforced Portland Cement Concretes, Concrete-Steel Composites, Polymer Composites, Reactive Powder Concretes, Reactive Powder Fiber-Reinforced Concretes, and the like.

As used herein, "cast-in-place" means that a portion or all of the span section is cast as wet concrete within formwork in or very near its final relative location within the overall structure as compared to being cast elsewhere (i.e., "precast") and transported to the site and assembled into its relative location in the structure. With a cast-in-place span there is typically reinforcing which laps over from one cast-in-place pour to another in order to connect the pours together. On the other hand, with precast sections the sections must be mechanically connected with bolts or weld plates or the two adjacent sections must be connected together with a cast-in-place pour to lap together the protruding reinforcing of adjacent precast sections.

Figure 1:
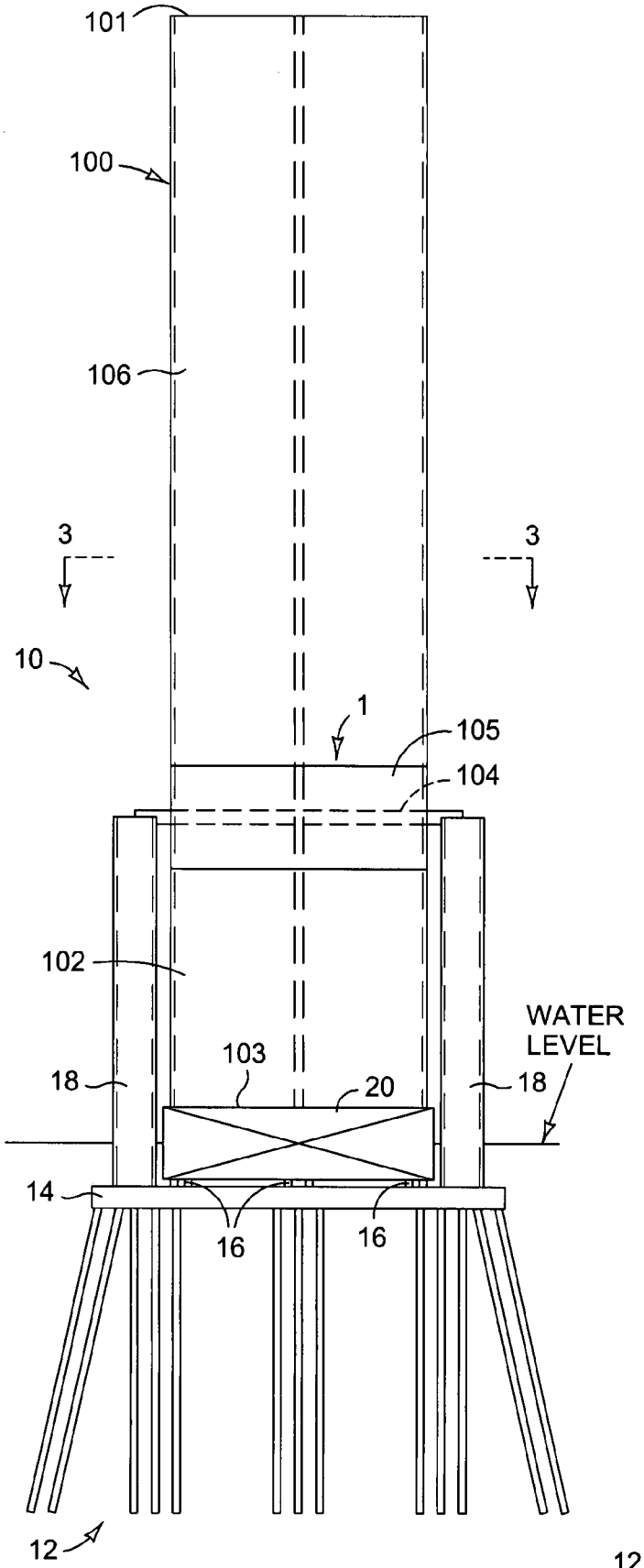
FIG. 1 is an end view depicting a construction site including an essentially vertically formed structure which is to be placed across an essentially horizontal span.
Figure 2:
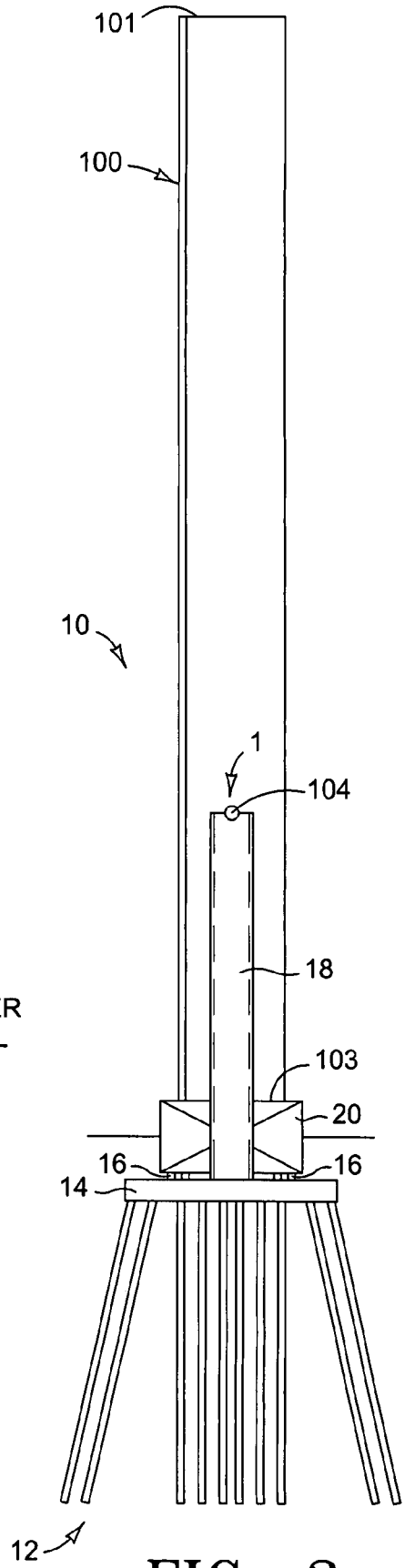
FIG. 2 is a front view of the essentially vertically formed structure depicted in FIG. 1, as seen from a pivot end of the span.
Figure 3:
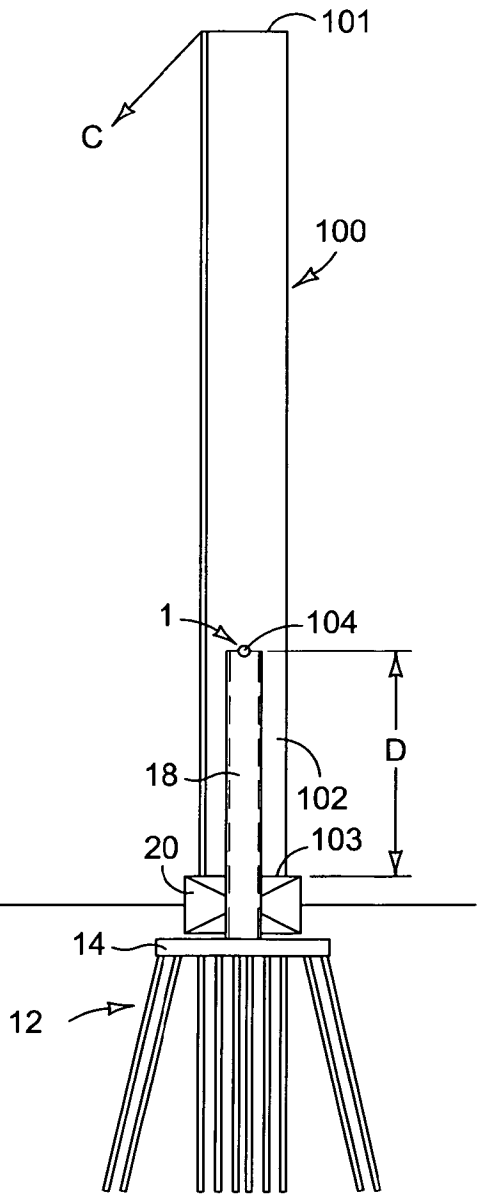
FIG. 3 is a sectional view depicting the essentially vertically formed structure of FIGS. 1 and 2.
Figure 3:
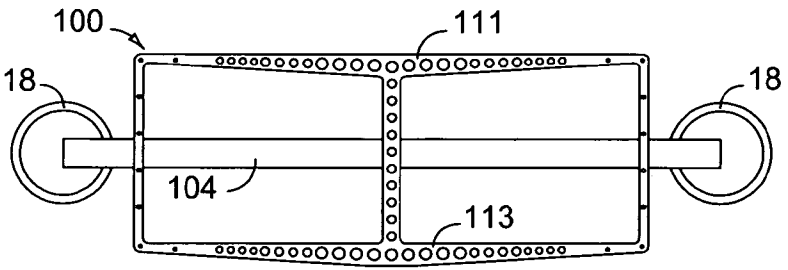

Turning now to FIG. 1, a construction site 10 is depicted in an end view. The construction site 10 includes an essentially vertically formed structure 100 which is to be placed across an essentially horizontal span (not visible in this view). FIG. 2 is a front view of the construction site 10 depicted in FIG. 1, and also shows the vertically formed structure 100. FIG. 3 is a cross section of the vertically formed structure 100 of FIGS. 1 and 2. FIGS. 1, 2 and 3 will all be discussed together. In the example depicted in FIGS. 1 and 2, the structure 100 is a bridge span (or a section of a bride span) which is intended to be placed across a body of water, indicted by the "water level". The structure 100 can be provided as a concrete structure, and is preferably formed in-place on a first support 14. As mentioned previously, the structure 100 can be formed using prior art concrete casting methods and apparatus, or using methods and apparatus described in my patent application Ser. No. 10/131,838 and/or 10/166,406. An example of using an apparatus as per these earlier patent applications will be described below with respect to FIGS. 12 through 17. As depicted in FIGS. 1 and 2, the first support 14 can be a cast pile cap supported by pilings 12. The first support 14 can also be a spread foundation which is supported by surrounding earth or pilings 12. The first support 14, and the pilings 12, can be enclosed within a caisson (not shown) to isolate them from the water level in a surrounding body of water.

FIG. 3 is a cross section depicting the structure 100, and shows the structure as being a box-girder type structure forming a bridge deck (or a bridge deck component) having an upper deck 111 and a lower deck 113. The structure 100 is depicted as being a hollow-core structure to reduce weight of the structure, while providing sufficient strength for the structure 100 to be placed in a generally horizontal position and support anticipated loads on the structure. The structure 100 can further include post-tensioning ducts (not shown) which are configured to receive post-tensioning tendons to allow the structure to be post-tensioned to prove additional strength when the structure 100 is placed in the generally horizontal position. The structure 100 is defined by a first end 103 and a distal, opposite second end 101. A counterweight 20 can be attached to the first end 103 of the structure 100. The counterweight 20 can facilitate controlled pivoting or rotation of the structure 100 from the essentially vertical position depicted in FIGS. 1 and 2 to the generally horizontal position depicted in FIG. 5. Removable spacers 16 can be provided between the counterweight 20 and the first support 14.

The work site 10 of FIGS. 1 and 2 further includes pivot piers 18 positioned on either side of the structure 100, and which are supported by the support 14. The pivot piers 18 in turn support a pivot shaft 104, which is supported at a support location 1 (or "pivot end") within a diaphragm 105 in the structure 100. The diaphragm 105 is located between a lower section 102 of the structure 100, and an upper section 106 of the structure. In one variation, rather than the pivot shaft 104 passing between the pivot piers 18 through the diaphragm 105, separate pivot shafts can be provided at each side of the structure 100, and can be individually supported by the pivot piers 18 and the diaphragm 105. It will be noted that the pivot location 1 is distal from the first end 103 of the structure 100, but is preferably closer to the first end 103 of the structure 100 than to the second end 101. Preferably, the mass of the counterweight 20 is selected such that the mass of the counterweight, the mass of the lower section 102 of the structure 100, and the mass of the diaphragm 105 which is below the pivot shaft 104 maintain the structure 100 in the essentially vertical position, and no moment is produced about the pivot shaft 104 by the mass of the second segment 106 and the portion of the diaphragm 105 which are above the pivot shaft 104. The mass of the counterweight 20 should also be selected to maintain the structure 100 in the essentially vertical position even in the event of maximum anticipated wind and seismic forces which might act on the upper portion 106 of the structure 100. This allows for the structure 100 to be pivoted from the essentially vertical position depicted in FIGS. 1 and 2 to the generally horizontal position depicted in FIG. 5 only under the application of a selected external force which will create a positive moment about the pivot location 1.

One method of producing the structure 100 and support 14 depicted in FIGS. 1 and 2 is as follows. First, a deep foundation (e.g., pilings 12) is formed, after which the first support 14 can be supported on the deep foundation. (When surrounding soil conditions permit, the pilings 12 are not required, and the support 14 can be a spread foundation supported by the surrounding soil.) The removable spacers 16 can then be placed on the first support 14, and the pivot piers 18 can be cast in-place on the first support. The counterweight 20 can be supported on the spacers 16 at this time. The lower section 102 of the structure can be formed on top of the counterweights 20 in such a manner as to allow for the counterweights to be later detached from the lower section 102. For example, threaded bolts (not shown) can be passed through openings (also not shown) within the counterweights 20 such that exposed threaded ends of the bolts are upward-facing. Female receptors (not shown) can then be applied to the upward-facing threaded ends of the bolts. A concrete-adhesive resistant material (such as a sheet of TFE) (not shown) can be placed over the upward-facing surface of the counterweight 20. Thus, when the lower segment 102 of the structure 100 is cast, the receptors will be embedded within the lower segment. Later, the bolts can be removed from the receptors, and the adhesive resistant material will allow for the easy removal of the counterweight 20 from lower section 102. Access can be provided for post-tensioning anchors (not shown) in the lower section 102 by providing openings (also not shown) in the counterweight 20.

After the lower segment 102 has been formed, then a composite steel/concrete diaphragm 105, which can include the pivot shaft 104, can be attached to the lower segment 102. This can be accomplished by forming upward-extending studs (not shown) into the lower segment 102, which can be used to connect the diaphragm 105 to the lower segment 102. Thereafter, the upper segment 106 of the structure 100 can be formed on top of the diaphragm 105. The upper segment 106 can be secured to the diaphragm 105 by securing upward-extending studs (not shown) into the diaphragm, which can then be used to connect the diaphragm 105 to the upper section 106 of the structure 100. Once the upper section 106 has been formed, any post-tension tendons (not shown) can be placed in post-tension conduits (also not shown) in the structure 100, and post-tensioning of the structure 100 performed. At this point, the structure 100 can be pivoted from the essentially vertical position depicted in FIGS. 1 and 2 to the generally horizontal position depicted in FIG. 5.

Figure 4:
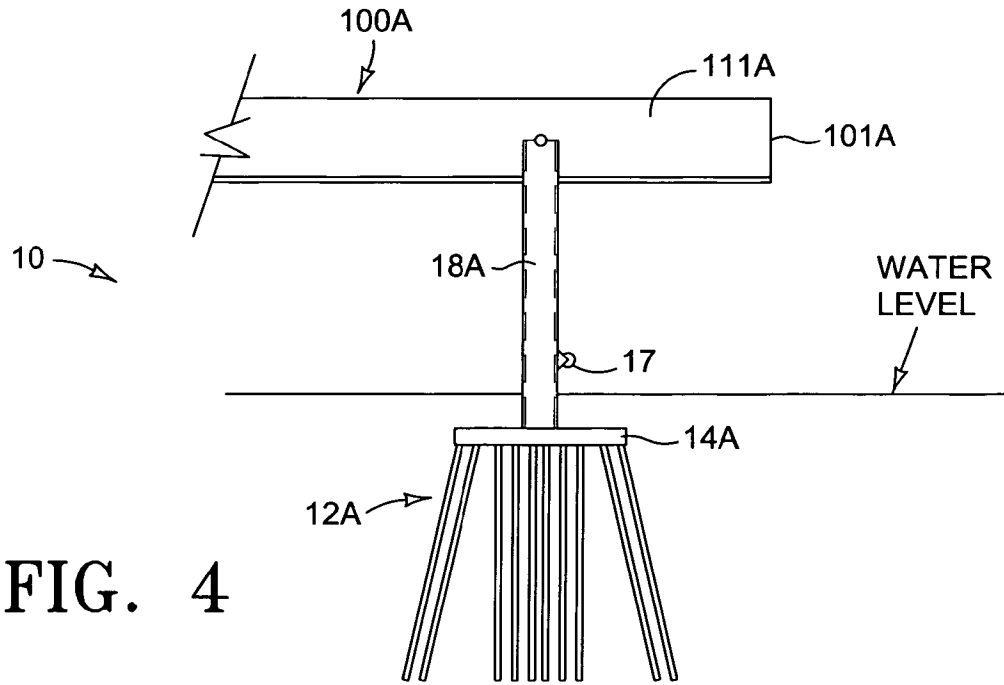
FIG. 4 is a front view of the essentially vertically formed structure of FIGS. 1 and 2, and further depicting the span across which the structure is intended to be placed.

Turning now to FIG. 4, a front view of the construction site 10 of FIG. 2 depicts the essentially vertical structure 100 as supported on first support 14, as well as a second generally horizontal structure 100A which is supported by second support structure 14A, which is in turn supported by second piers 12A. As can be seen, the second structure 100A is supported on the second support 14A by pivot piers 18A, which generally perform similar to pivot piers 18. As can be seen, the second structure 100A includes a cantilevered section 111A which extends beyond the support piers 18A and terminates at second structure first end 101A. A rigging connection 17 can be provided to the pivot piers 18A, allowing a winch (not shown) to connect the second end 101 of the structure 100 to the pivot pier 18A. The winch can then be used to pivot the structure 100 about the pivot point 1 of the structure 100 to move it from the essentially vertical position depicted in FIG. 4 to the generally horizontal position depicted in FIG. 5. The winch (not shown) applies an initial general shear force to the second end 101 of the structure 100 to thereby create a moment about the pivot shaft 104. However, other methods of applying a moment about the pivot point 1 can be provided, such as applying a rightward force (as viewed in FIG. 4) to the lower section 102 of structure 100, or to the counterweight 20, or by applying a torsional force about the pivot shaft 104. However, prior to applying a force to the structure 100 to cause it to pivot about the pivot point 1 in direction "C", the spacers 16 (FIG. 2) between the first support 14 and the counterweight 20 are preferably removed to facilitate free pivotal movement of the structure 100 about the pivot shaft 104. Removal of the spacers 16 can be facilitated by slightly jacking the structure in an upward direction using the pivot shaft 104, to thereby free the spacers 16 from the area between the first support 14 and the counterweight 20. In one variation the spacers 16 can be designed to be removable without jacking the structure 100 upwards. For example, the spacers 16 can be a collapsible-type spacer such as an opposed sets of wedges or a jack.

Figure 5:
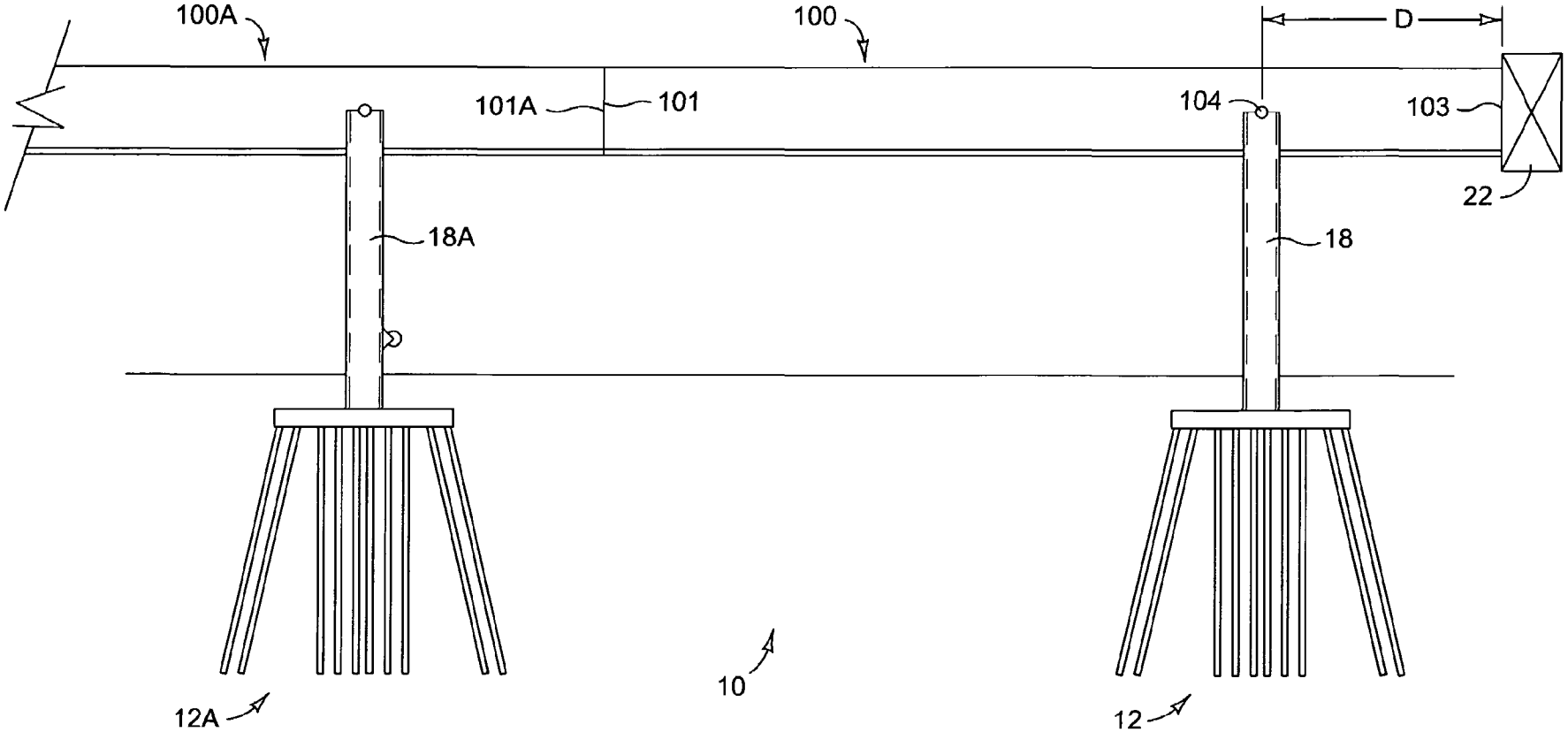
FIG. 5 is a front view of the essentially vertically formed structure of FIGS. 1 and 2, and further depicting the structure as being rotated or pivoted to be placed across the span which the structure is intended to be placed.

As depicted in FIG. 5, the first structure 100 has been placed in a generally horizontal position in general alignment with the second structure 100A. It will be observed that an expanse "D" defined between the first end 103 and the pivot point 1 of the first structure 100 (FIGS. 4 and 5) protrudes beyond the pivot shaft 104 when the structure 100 is placed in the generally horizontal position (FIG. 5), and that the second end 101 of the structure 100 mates with the first end 101A of a generally cantilevered section of second structure 100A. The second end 101 of the first structure 100 can be connected to the first end (free end) 101A of the second structure 100A. Afterwards the counterweight 20 can be removed from the first structure 100. In this way, a plurality of structures can be joined together to span an expanse which is greater in overall length than the length of any particular structure used in spanning the expanse. Furthermore, the rightward-end 103 of the first structure can be connected to a ramp or the like to thereby connect the structures 100 and 100A to a ground supported roadway or the like. Likewise, the leftward end of the structure 100A can be connected to a ramp or the like to thereby connect the structures 100 and 100A to a ground supported roadway or the like.

Figure 6:
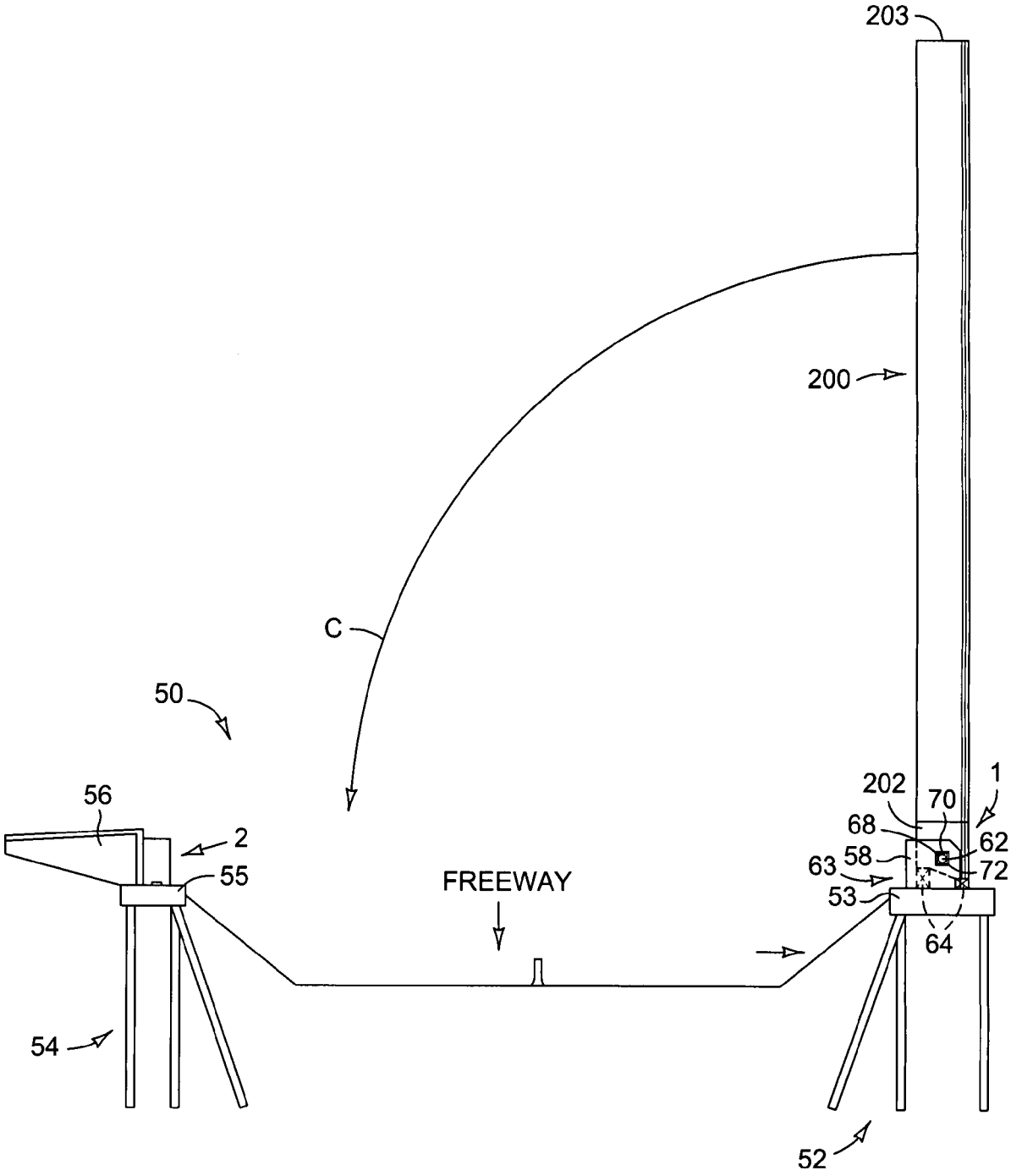
FIG. 6 is a front view depicting a span across a freeway, and a vertically formed structure which is intended to be placed across the span.
Figure 7:
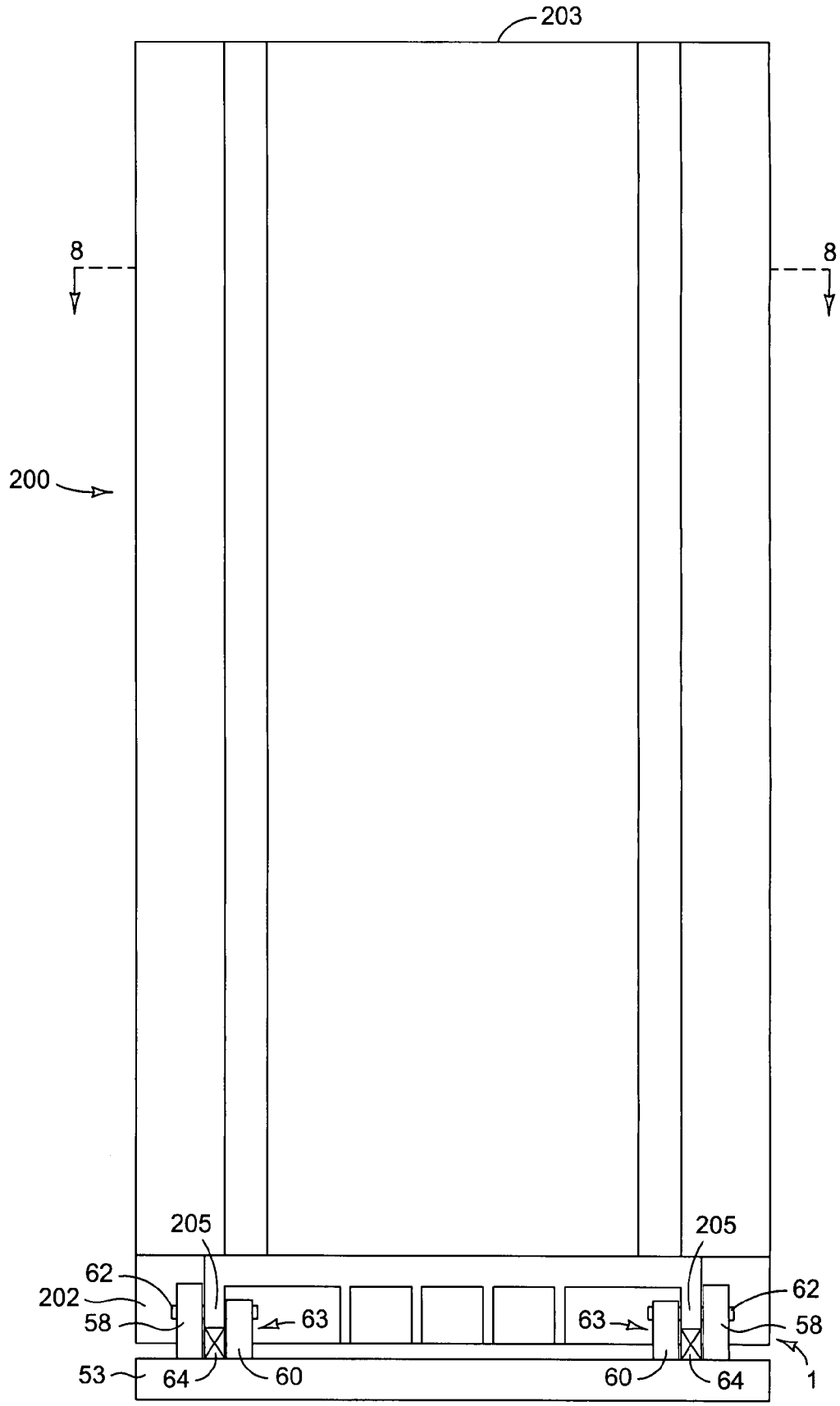
FIG. 7 is a side view depicting the structure that is to be placed across the span depicted in FIG. 6.
Figure 8:
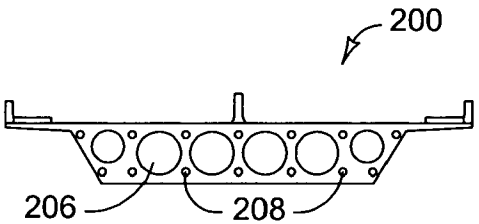
FIG. 8 is a plan sectional view of the vertically formed structure depicted in FIGS. 6 and 7.

Turning now to FIG. 6, a front view depicts a work site 50 wherein a span across a freeway is defined by a first support 53 and a second support 55. The work site 50 includes a vertically formed structure 200 which is intended to be placed across the span. The structure 200 can be a concrete structure formed in the essentially vertical position using known prior concrete forming methods, or it can be formed using methods and apparatus described in my patent application Ser. No. 10/131,838 and/or 10/166,406. FIG. 7 is an end view of the structure 200 of FIG. 6, and FIG. 8 is a plan sectional view of the structure 200 of FIGS. 6 and 7. FIGS. 6, 7 and 8 will be described in detail together. The structure 200 is depicted as being a freeway overpass, which is initially supported in an essentially vertical position at a pivot end 1 (also known as "first end" or "first support location") by first support 53. First support 53 can be a pile cap (supported by piling 52) or a spread foundation (support by the earth or by pilings 52). The structure 200 is further defined by a second end 203 which is distal from the first end 1 of the structure 200. The structure 200 is pivotably supported at the pivot end 1 and is intended to be pivoted in direction "C" from the essentially vertical position depicted in FIG. 6 to the generally horizontal position depicted in FIG. 9, at which point the second end 203 of the structure 200 will be supported at the free end 2 of the span over the freeway. The free end of the span includes second support 55, which can be a pile cap supported on pilings 54, for example. An approach ramp 56 can connect the free end 2 of the span to the structure 200 when the structure is in the generally horizontal position. As can be seen in the cross section of the structure 200 depicted in FIG. 8, the structure can be a honeycomb type structure having hollow openings 206 formed therein to reduce weight of the structure, but still allow the structure 200 to have strength when placed in the generally horizontal position. Further, the structure 200 can be provided with post-tension conduits 208 which are configured to receive post-tensioning tendons (not shown), thus allowing post-tensioning to be applied to the structure 200 before it is placed in the generally horizontal position.

As depicted in FIGS. 6 and 7, pivot piers 58 and 60 can be formed on the first support 53 (as depicted, two sets of pivot piers are formed, each set consisting of spaced-apart piers 58 and 60, with the sets of piers being located proximate the sides of the structure 200). A diaphragm 202 is then formed over the pivot piers (using conventional concrete forming methods, for example). The diaphragm 202 can be a steel/concrete composite structure. The diaphragm 202 includes two web or flange portions 205 which are received between the respective sets of pivot piers 58 and 60. A pivot shaft 62 is passed through each set of pivot piers 58 and 60, as well as the flange portion 205 of the diaphragm 202 that is positioned between the pivot piers. In this way, a pivot end 1 (which can also be described as a "first support location") is formed for the structure 200. Alternately, the flange portion 205 can be provided as a separate steel structure, and as part of the pivot assembly 63, and the diaphragm 202 can be cast from concrete to connect to the to flange portion 205 using pins or other extensions from the flange portion 205 to engage the concrete in the diaphragm 202. Spacers or removable support blocks 64 can be placed between the first support 53 and the diaphragm 202 to hold the structure 200 in place in the essentially vertical position until such time as the structure is to be pivoted or lowered to the generally horizontal position, at which time the spacers 64 can be removed. The pivot assembly 63 can include a journal 68 which supports the pivot shaft 62. The journal 68 can be located within a cutout 70 formed in the pivot piers 58 and 60, and a space 72 can be provided between the journal 68 and the cutout 70. The space 72 allows the elevation of the rightward end of the structure 200 to be adjusted to be level after the structure has been placed in the generally horizontal position, as will be described more fully below. FIG. 9 is a front view depicting the work site 50 of FIG. 6 after the structure 200 has been pivoted in direction "C" from the essentially vertical position (depicted in phantom lines by 200') to the generally horizontal position. After being placed in the generally horizontal position, the second end 203 of the structure 200 will rest on the second support 55 at the free end 2 of the span over the freeway.

An exemplary set of steps that can be used to produce the freeway overpass depicted in FIGS. 6 through 9 is as follows. First the foundations (e.g., pilings 52 and 54) are cast or otherwise put in place. The supports 53 and 55 are then formed on the respective foundations 52 and 54. The pivot piers 58 and 60 (two sets of each) are then cast or otherwise formed on the first support 53 at the support location or pivot end 1. The pivot journals or bearings 68, as well as the journal housing 70, are placed in the pivot piers 58 and 60 during this step, and the removable spacers 64 are put in place on the first support 53. If the flange portion 205 is provided as a steel structure, then this component is installed between the pivot piers at this time, and the pivot shafts 62 are placed in the pivot journals 68. The pivot end diaphragm 202 is then cast to engage the flange portion 205 of the pivot assembly 63. The concrete structure 200 is then formed in place, and in an essentially vertical position, on the diaphragm 202. The structure 200 can be formed using prior art methods, or preferably is formed using methods and apparatus described in my U.S. patent application Ser. No. 10/131,838 and/or 10/166,406. The formed structure 200 can then be post-tensioned at this time, using the post-tensioning ducts 208 (FIG. 8) formed in the structure during its fabrication. The structure 200 can then be stabilized in the vertical position using a crane or the like, and the structure can be lifted slightly upwards by placing jacks under the pivot shafts 62 and jacking the whole structure upwards. This allows the spacers 64 to be removed from under the pivot assembly flanges 205. Alternately, a collapsible form of spacer can be used to eliminate the step of lifting the structure 200 to remove the spacers 64. Temporary shims (not shown) can be placed in the openings 72 which are formed between the journals 68 and the journal housings 70 in order to allow smooth rotation of the structure 200 about the pivot shafts 62. The structure 200 is then rotated or pivoted in direction "C" about the pivot end 1 until the second end 203 of the structure 200 is seated at the support 55 on the free end 2 of the span. The structure 200 can be rotated about the pivot end 1 using a crane or the like. Alternately, the structure can be pivoted using the methods and apparatus described later herein with respect to FIGS. 14 through 19. Any final post-tensioning of the structure 200 can be performed at this time, if necessary. The structure 200 can then be leveled at the pivot end 1 by jacking the pivot shafts 62 slightly upward to allow the temporary shims to be removed, and the pivot shafts 62 can then be further positioned using jacks or the like until the free end 1 of the structure is aligned as desired. Once the free end 1 of the structure 200 is properly aligned, grout can be placed in the openings 72 between the journals 68 and the journal housings 70 to hold the free end in the desired position. The job site 50 can be finished by forming the approach 56 at the second support 55, and a similar approach can be formed adjacent the first support 53. Finishing (such as curbs, sidewalks, railings, etc.) can then be applied to the structure to complete the installation.

Turning now to FIG. 10, a variation on the embodiment of the invention depicted in FIG. 9 is provided. FIG. 10 is a front view of a job site 90, which provides for the installation of two in-line structures over a freeway to result in a continuous freeway overpass. As can be seen, once put in place the overpass will include a first structure 250 and a second structure 252 which are joined at a central column 99 which is located in the freeway and which defines a common free end 2 for each of the structures. First structure 250 is initially formed on first support 92 (which is supported by piers 91) in an essentially vertical position, as indicated in phantom lines by 250'. The first structure 250 is supported at a first pivot end ("first support location") 1 by a pivot assembly 96, which can be similar to the pivot assembly 63 of FIGS. 6 and 7. Similarly, the second structure 252 is initially formed on second support 94 (which is supported by piers 93) in an essentially vertical position, as indicated in phantom lines by 252'. The second structure 252 is supported at a second pivot end 3 ("second support location") by a pivot assembly 95, which can be similar to the pivot assembly 63 of FIGS. 6 and 7. After the structures 250' and 252' are formed in the vertical position they can be lowered into the generally horizontal position shown by 250 and 252. The forming and rotation of each structures 250, 252 can be performed in the same manner as described above for structure 200 depicted in FIGS. 6 through 9. Approaches 97 and 98 can be provided at respective first and second pivot ends 1 and 3 to complete the overpass.

Turning to FIG. 11, another variation on the embodiments of the invention depicted in FIGS. 9 and 10 is provided. FIG. 11 is a front view of a job site 30, which provides for the installation of two in-line structures over a divided freeway ("Freeway I" and "Freeway II") to result in a continuous freeway overpass. As can be seen, once put in place the overpass will include a first structure 270 and a second structure 272 which are joined at respective central supports 36A and 36B, both located on piling 35 towards the divider between the two freeways. Support 36A supports the first structure 270 at a first free end 1A, while support 36B supports the second structure 272 at a second free end 1B. The first structure 270 is provided with a pivot assembly 273 at the first pivot end ("first support location") 1A, and the second structure 272 is provided with a pivot assembly 274 at the second pivot end ("second support location") 1B. Pivot assemblies 273 and 274 can be similar to the pivot assembly 63 of FIGS. 6 and 7. The first structure 270 is constructed in an essentially vertical position, as depicted by phantom lines 270', and the second structure 272 is constructed in an essentially vertical position, as depicted by phantom lines 272'. After the structures 270' and 272' are formed in the essentially vertical position, they can then be lowered into the generally horizontal position shown by 270 and 272 such that the first structure 270 is ultimately supported in a generally horizontal position between the first pivot end 1A and a first free end 2A, while the second structure 272 is ultimately supported in a generally horizontal position between the second pivot end 1B and a second free end 2B. The forming and rotation of each of the structures 270 and 272 can be performed in the same manner as described above for, structure 200 depicted in FIGS. 6 through 9. Approaches 38 and 39 can be provided at respective first and second free ends 2A and 2B to complete the overpass.

Figure 12:
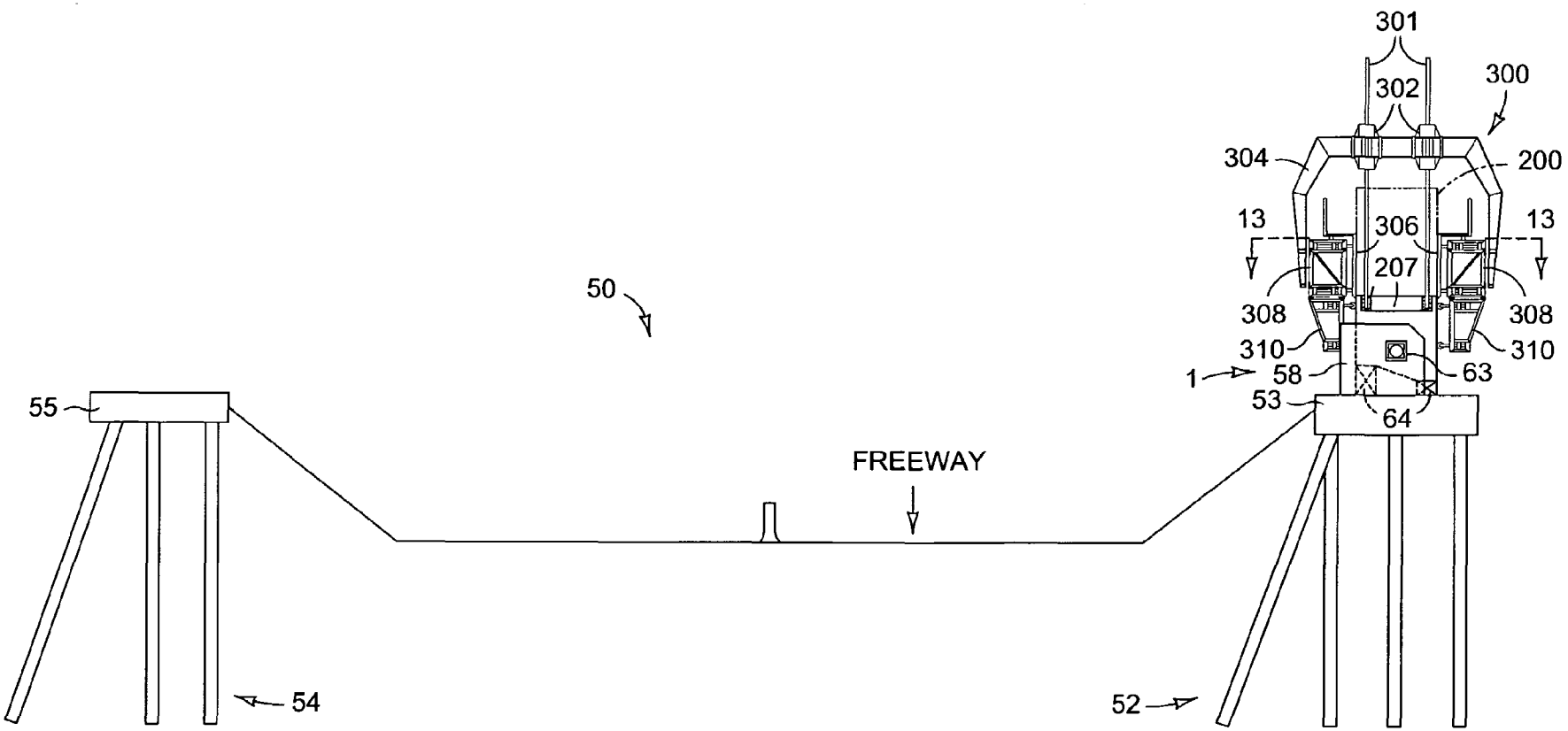
FIG. 12 is another front view of the span depicted in FIG. 6, depicting an apparatus that can be used to form the vertical structure depicted in FIG. 6.

Turning now to FIG. 12, a front view of the job site 50 of FIG. 6 is again depicted, however in FIG. 12 a vertical concrete structure forming apparatus 300 is depicted which can be used to form the concrete structure 200 (FIG. 6). The structure forming apparatus 300 generally corresponds to the jump-slip forming machine depicted in various embodiments in my U.S. patent application Ser. No. 10/131,838. After the pilings 52 and first support 53 have been put in place at the pivot end ("support location") 1 of the span over the freeway, and the pivot piers 58 (and 60, FIG. 6) have been cast, the spacers 64 (FIG. 6) and pivot assembly 63 (FIG. 6) can be installed in the manner described above with respect to FIGS. 6 and 7. The diaphragm 202 (FIG. 6) can then be formed over the flange assembly (205, FIG. 6), after which an initial casting 207 (FIG. 12) can be formed using the structure forming apparatus 300. Climb rods 301 can then be placed in the initial casting to allow the structure forming apparatus 300 to climb upwards and thereby form the essentially vertical concrete structure 200 of FIG. 6.

Figure 13:
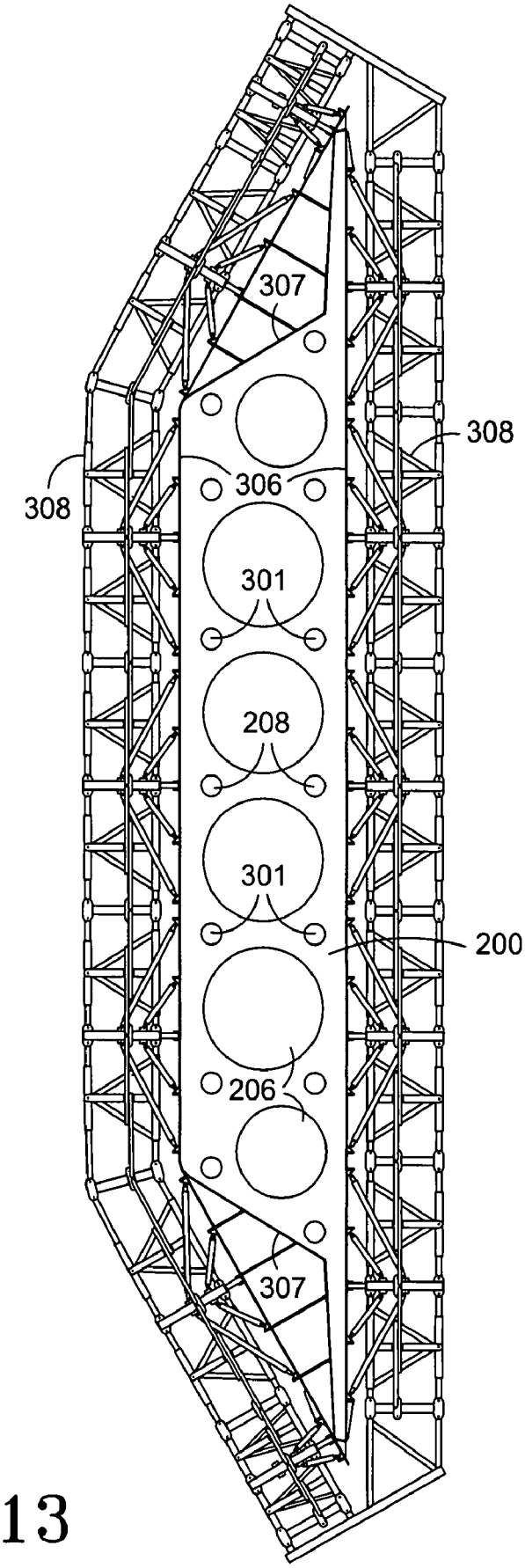
FIG. 13 is a plan view of a portion of the structure forming apparatus depicted in FIG. 6.

The structure forming apparatus 300 of FIG. 12 includes a yoke 304 which is configured to move upwards along the climb rods 301 via climbing devices 302, which can be screw jacks or the like. The yoke 304 in turn supports a plurality of truss modules 308, which in turn support the generally opposing concrete forms 306. Turning briefly to FIG. 13, a plan view of the structure forming apparatus 300 sectioned immediately above the truss modules 308 of FIG. 12 is depicted. As can be seen, in addition to supporting the generally opposing forms 306, the truss modules 308 can also support corner forms 307 which allow the structure 200 to achieve a desired cross sectional shape. The openings 206 and tendon conduits 208 can be formed using methods and apparatus described in my U.S. patent application Ser. No. 10/166,406. Returning to FIG. 12, the structure forming apparatus 300 can further include attitude control modules 310 which can be supported either from the truss modules 308 as depicted, or directly from the yoke 304. The attitude control modules are configured to engage the evolving concrete structure 200 to thereby guide the forms 306 along the climb rods 301. By applying greater or lesser forces against the evolving structure 200 with the attitude control modules 308, the structure forming apparatus 300 can be "steered" along the climb rods 301 to reduce sway in the evolving structure 200, or to impart a particular curvature to the structure 200. In this way the form of the evolving structure 200 can be tightly controlled using a guidance and control system (not shown) to periodically adjust the attitude control modules 308.

Figure 14:
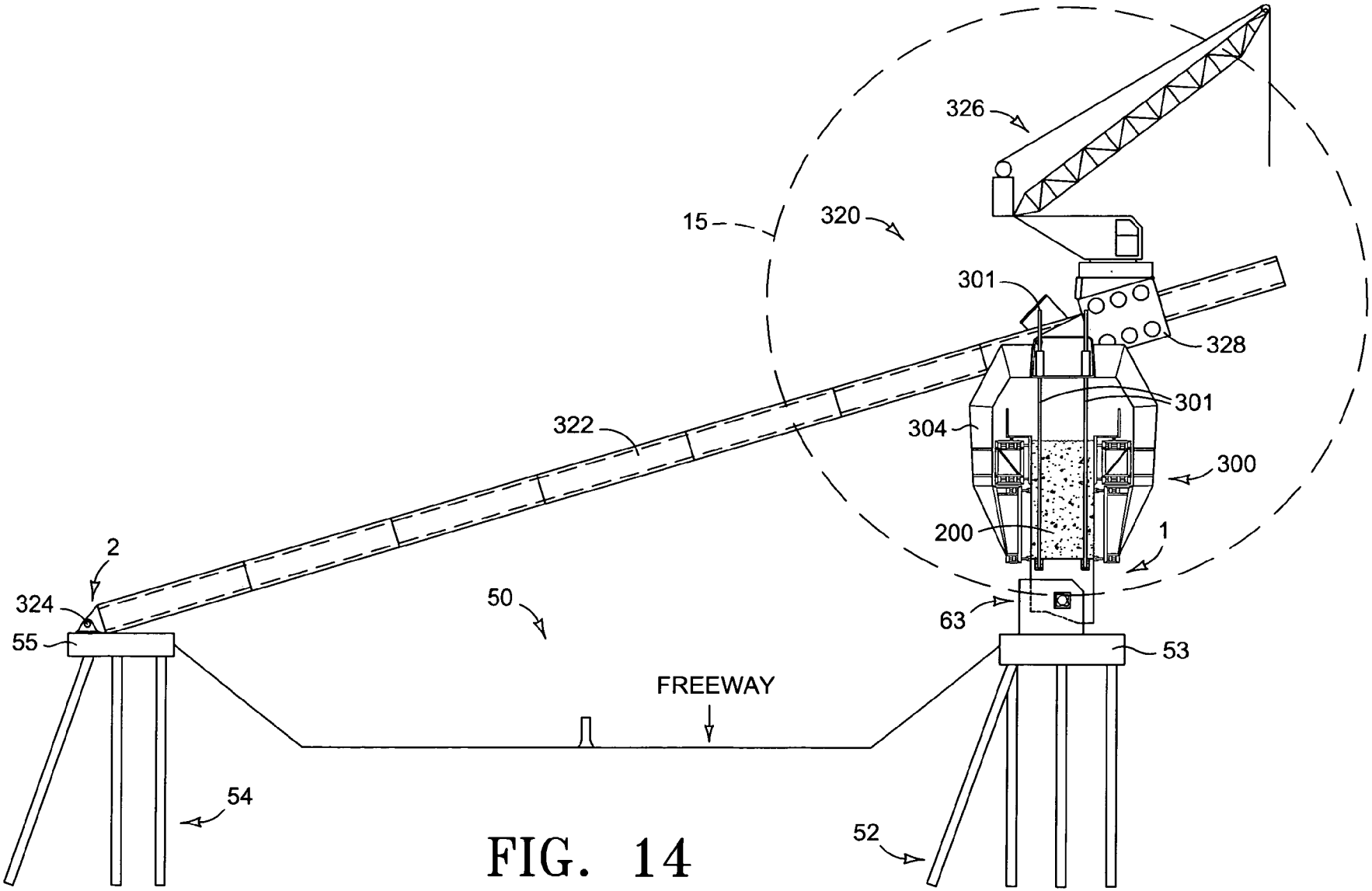
FIG. 14 is another front view of the span depicted in FIG. 12, depicting a structure lowering apparatus in accordance with an embodiment of the present invention.

Turning now to FIG. 14, another front view of the construction site 50 of FIGS. 6 and 12 is depicted. FIG. 14 is similar to FIG. 12 in that a structure forming apparatus 300 is shown which can be used to form the essentially vertical concrete structure 200. However, in FIG. 14 a structure lowering apparatus 320 has been added. The structure lowering apparatus 320 can be used to lower the concrete structure 200 from an essentially vertical position at the first support location 1 to a generally horizontal position so that the structure 200 is supported at the first and second support locations (1, 2) by respective first and second supports 53 and 55. As depicted in FIG. 14 the structure lowering apparatus 320 includes a boom 322 which is pivotably supported at a first end of the boom by second support 55. A pivot hinge 324 can be used to provide the pivotable mounting of the first end of the boom 322 to the support 55. The structure lowering apparatus 320 further includes a lowering jack 328 which engages and is configured to move along the boom 322, and which is configured to be pivotably attached to the second (upper) end of the concrete structure 200. As depicted in FIG. 14, the lowering jack is supported indirectly by the structure 200. That is, the lowering jack is supported by the yoke 304 of the structure forming apparatus 300, which is in turn supported by the climb rods 301 which protrude from the top of the structure 200. It will be appreciated that in one variation the structure lowering apparatus 320 can be used without the accompanied use of the structure forming apparatus 300. In this latter variation, the lowering jack 328 is supported directly on the structure 200 (or indirectly, such as via a brace or jacket or the like).

Figure 15:
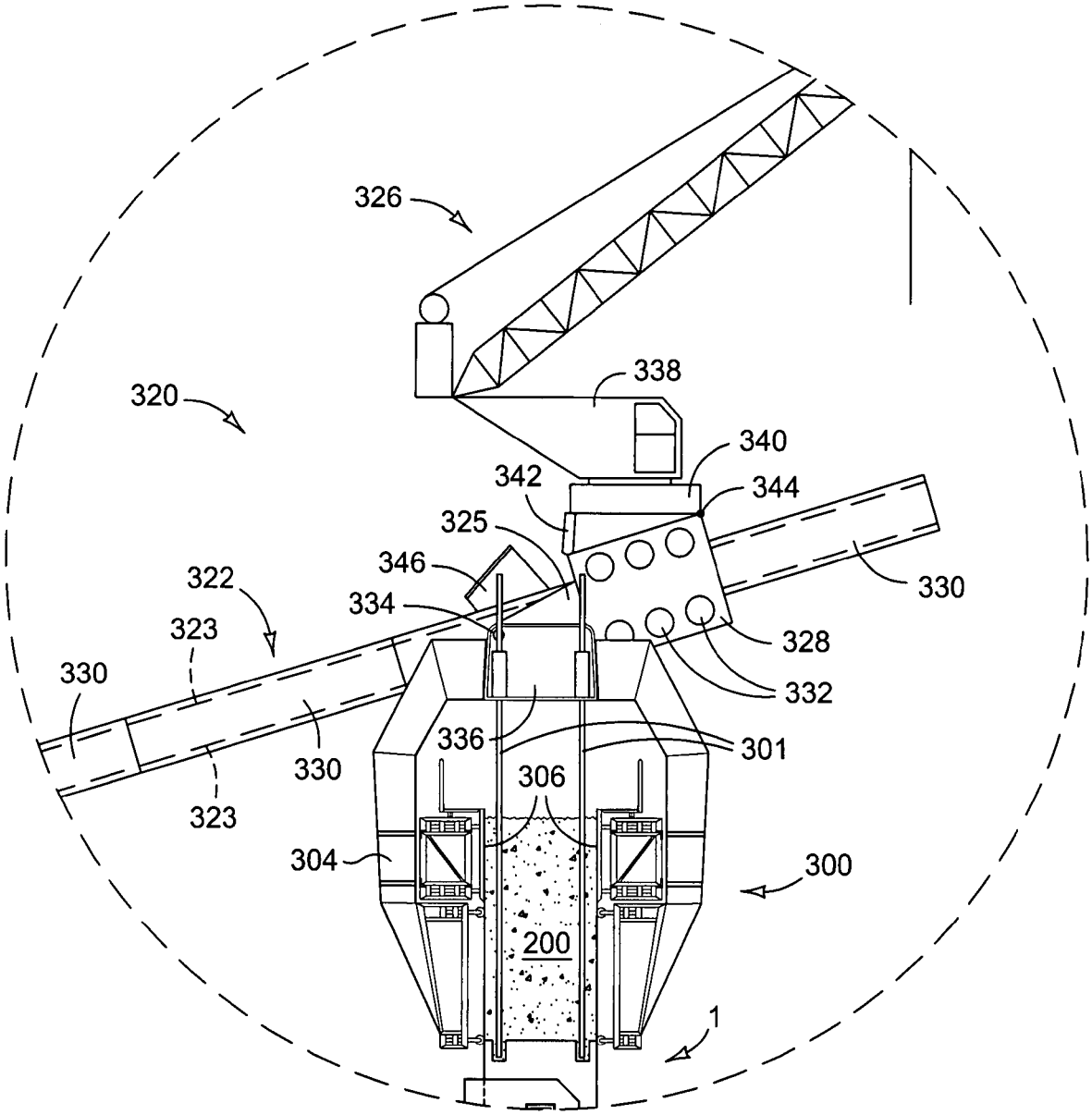
FIG. 15 is a detail front view of the structure forming apparatus and the structure lowering apparatus depicted in FIG. 14.

Turning to FIG. 15, a detail of the structure forming apparatus 300 and a portion of the structure lowering apparatus depicted in FIG. 14 is shown. As seen in FIG. 15, the boom 322 of the structure lowering apparatus 320 can be assembled from a number of detachably connectable boom segments 330 to facilitate disassembly of the boom (as will be described more fully below). The boom segments can be, for example, lattice trusses, tubular pipes, or box girders. Further, a crane 326 can be optionally supported on the lowering jack 328. The crane 326 can include an operator cabin 338 which is slewably supported on a base 340. The base 340 can be pivotably connected to the lowering jack by a hinge 344, and can further include a leveling device 342 which is disposed between the crane base 340 and the lowering jack 328. The leveling device 342 can be, for example, a hydraulic cylinder. The leveling device 342 allows the crane 326 to be maintained in a level position, as will also be described more fully below. The crane 326 can be used in construction of the structure 200, and can also be used to add and remove boom segments 330 to and from the boom 322, as will be described more fully below.

The lowering jack 328 can be connected to the boom 322 by plates 325 (only one of which is visible in FIG. 15) which are located on either side of the boom. The plates 325 can be connected to a top member or yoke cap 336 of yoke 304 with a hinge-type connection 334, such as a ball joint or a spherical bearing, to allow some differential movement between the two legs of the yoke 304. This differential movement can be limited by use of a rigid tie member 346 which is placed between the legs of the yoke 304. The tie member 346 can be rigidly fastened to the top yoke member 336 after the boom 322 and the lowering jack 326 are installed. The lowering jack 328 can be fabricated from cast steel or a welded plate structure in which is installed a number of jacking mechanical actuator pairs 332, which are preferably redundant. Jacking actuators 322 can include: (1) pinion gears or cog wheels which engage a rack (such as a gear rack) 323 on the boom to effect a reaction at any point along the boom; by way of example, the pinion gears 332 can be driven or retarded by planetary gear drives (not shown) in combination with hydraulic motors or variable frequency electric drives (also not shown); or (2) hydraulic cylinders (not shown) acting in pairs to effect, with cog engagement of the rack 323, a "walking" down or up of the jack 326 along the boom 322; or (3) a worm-type screw drive (not shown) which engages the rack 323 of the boom 322 and can effect a reaction against the boom at any point along it. Whatever method is used, redundancy is preferred within any one jack 328 such that there is sufficient safety factor left to hold the jack in a fixed position along the boom 322 until such time as any malfunctioning component in the jack 326 can be repaired and full redundancy is restored.

Figure 16:
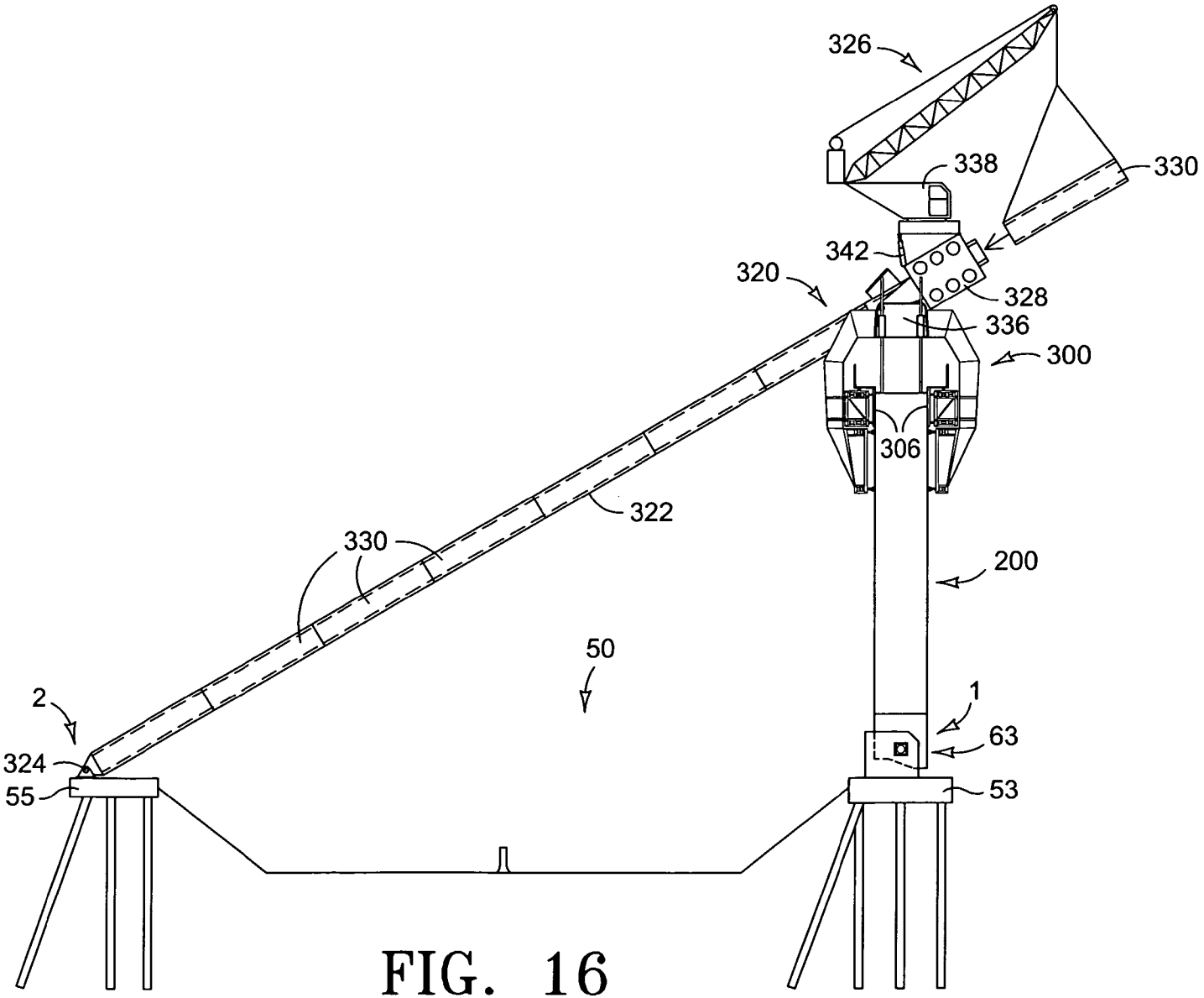
FIG. 16 is another front view of the span depicted in FIG. 14, showing how the structure lowering apparatus is formed as the vertical structure is being formed.

Returning to FIG. 14, as described previously the figure depicts the initial formation of the structure 200 using the structure forming apparatus 300. Turning now to FIG. 16, the structure 200 has been more fully evolved from the state depicted in FIG. 14. As can be seen, the crane leveling device 342 allows the operator cabin 338 to remain level with the ground. As the structure 200 is evolved upwards, the lowering jack 328 moves rightward and upward along the boom 322 to allow the lowering jack to maintain its lateral position with respect to the yoke cap 336. However, it will be noted that the lowering jack 328 has rotated slightly counter-clockwise from the position depicted in FIG. 14. As the lowering jack 328 moves upward and rightward, an additional boom segment 330 can be added to the boom 322 to accommodate the jack 328.

Figure 17:
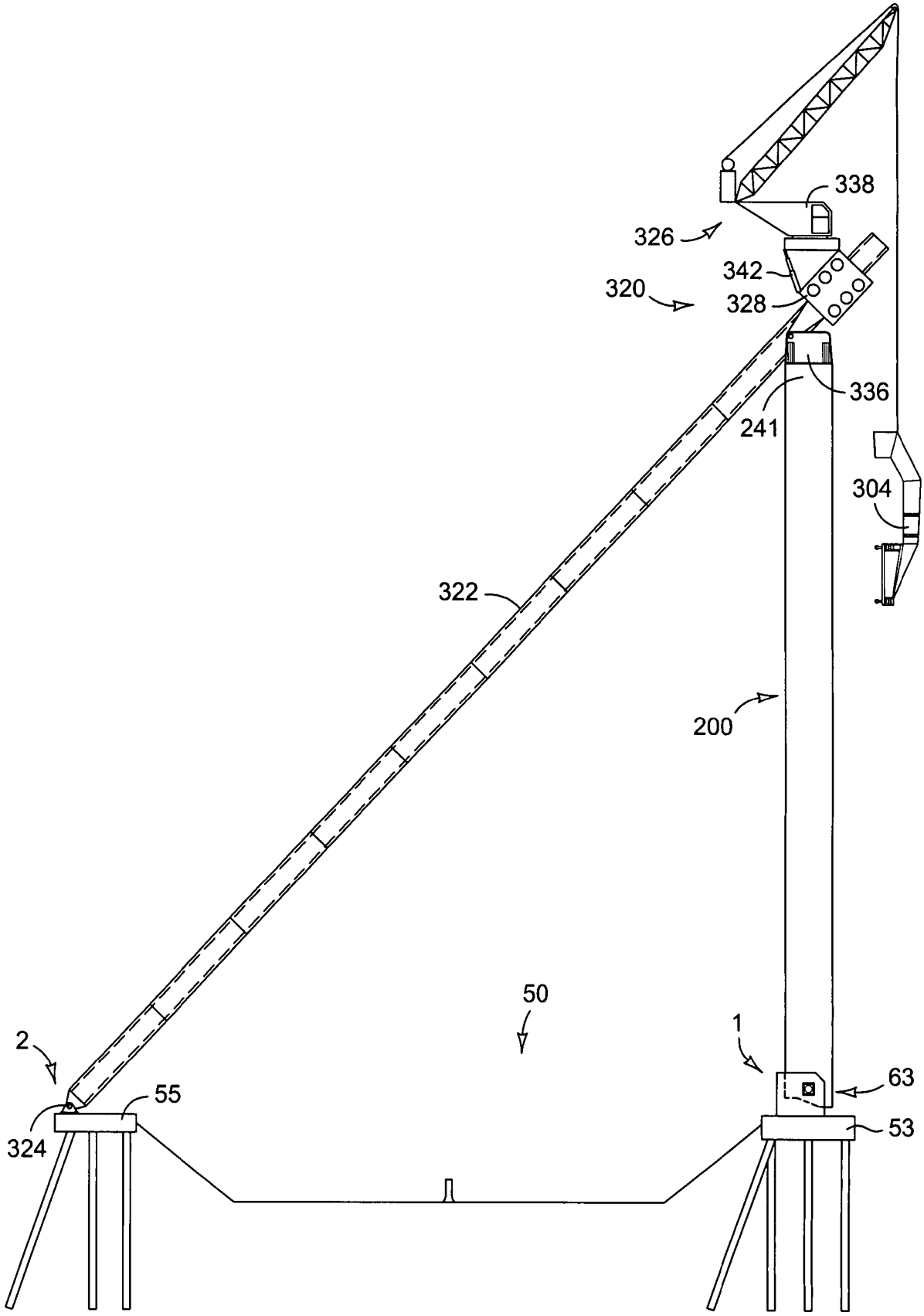
FIG. 17 is another front view of the span depicted in FIG. 16, depicting the vertical structure as fully formed and the structure lowering apparatus as completed, and the structure forming apparatus being disassembled.

Turning to FIG. 17, the structure forming process depicted in FIGS. 14 and 16 is depicted as being complete, with the concrete structure 200 completed in the essentially vertical position at the first support location 1. It will be noted that the upper portion 241 of the structure 200 can be formed by placing temporary form extenders (not shown) above the forms 306 of the structure forming apparatus since forms 306 do not extend all the way to the yoke cap 336 (see FIG. 16). As can be seen in FIG. 17, the crane operator cabin 338 is still maintained in a level position by virtue of the crane leveling device 342. As can also be seen, the lowering jack 328 has rotated further counter-clockwise from the position depicted in FIG. 16. As also depicted in FIG. 17, the crane 326 is in the final stages of disassembling and lowering the structure forming apparatus 300 (FIG. 16), and is depicted as lowering the last component of yoke 304. Once the final yoke member 304 has been lowered to the ground the structure 200 will be ready to be lowered from the essentially vertical position to a generally horizontal position. As described previously with respect to FIG. 6, at this point any partial or full pretension of the structure 200 can be performed, and the structure can be slightly lifted at the pivot assembly 63 to allow spacers (64, FIG. 6) to be removed.

Figure 18:
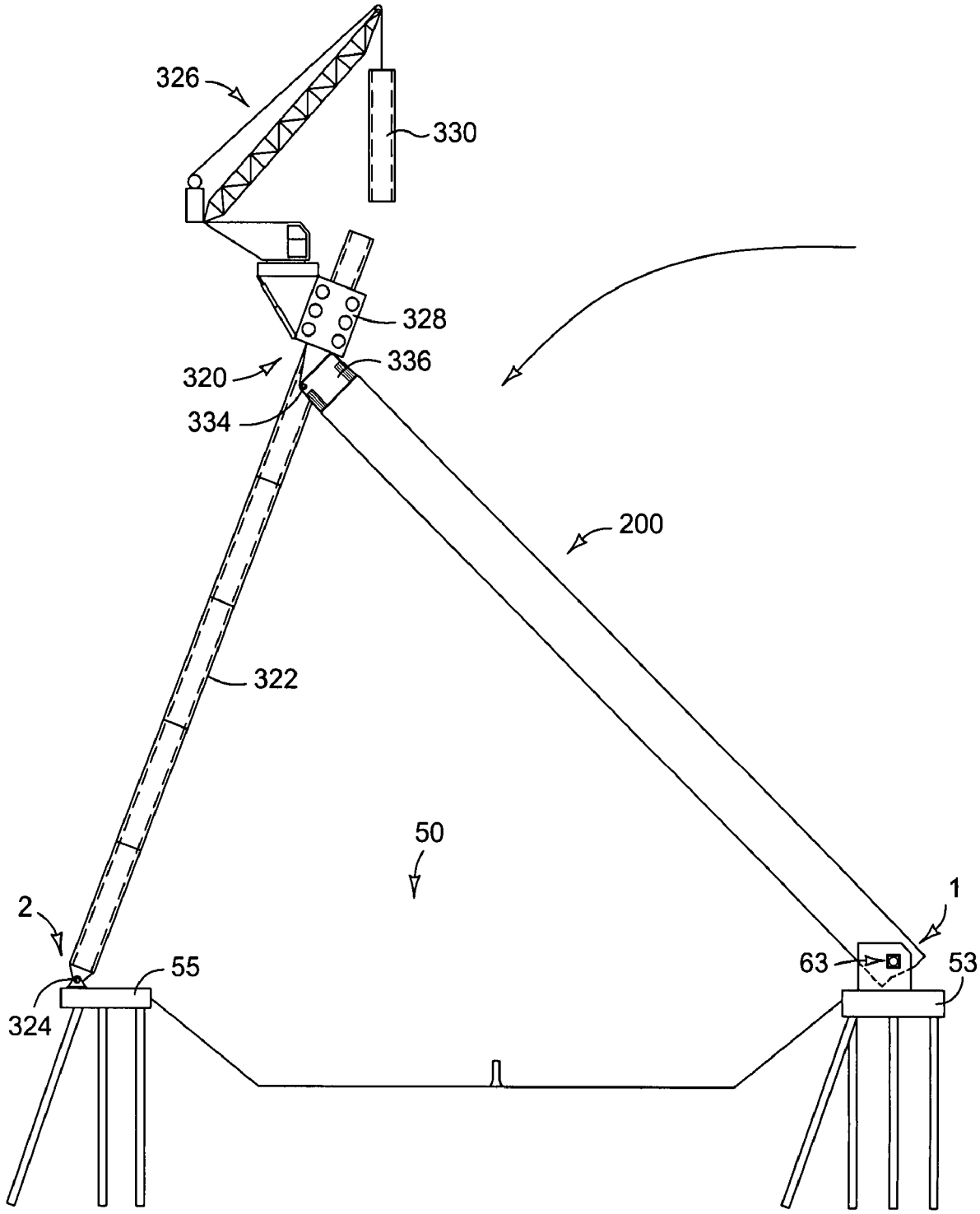
FIG. 18 is another front view of the span depicted in FIG. 17, depicting the structure lowering apparatus lowering the structure to a horizontal position over the span.

Turning now to FIG. 18, the structure 200 is depicted in the process of being lowered from the essentially vertical position of FIG. 17 to the generally horizontal position of FIG. 9. Lowering of the structure 200 is accomplished by moving the lowering jack 328 in a general leftward and downward direction along the boom 322. As the lowering jack 328 moves downward along the boom 322, the crane 326 can be used to progressively remove boom segments 330 that are no longer required for lowering of the structure 200. As the structure 200 is lowered the boom 322 pivots in a counter-clockwise direction about the pivot hinge 324 at the second support location 2.

Figure 19:
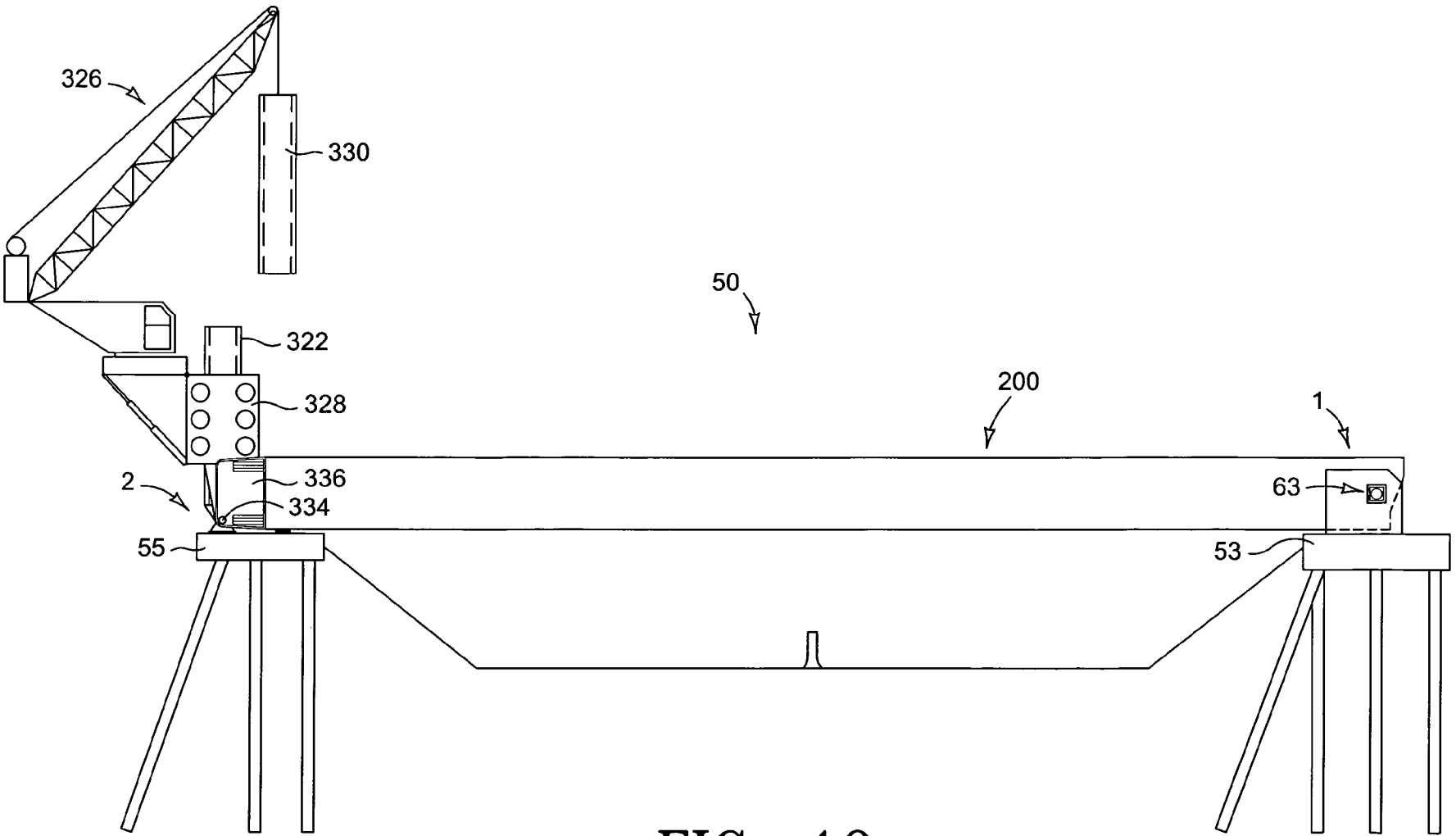
FIG. 19 is another front view of the span depicted in FIG. 18, depicting the structure as in-place over the span.

Turning now to FIG. 19, the structure 200 is depicted as being fully lowered into the generally horizontal position so that a first end of the structure 200 is supported on the first support 53 at the first support location 1, and a second end of the structure 200 is supported on the second support 55 at the second support location 2. At this point the crane 326, lowering jack 328, remaining boom segment 322 and yoke cap 336 can be removed from the second end of the structure 200. Finishing can now be applied to the structure 200 in the way of any final post-tensioning, provision of approaches (56, 74, FIG. 9) and application of sidewalks, curbs, railings, etc. (all not shown in FIG. 19).

Although FIGS. 1 through 19 have depicted embodiments of the invention pertaining to forming and placing bridge spans it will be appreciated that the methods and apparatus described can be used to form and place any generally horizontal structure, including, by way of example only, pipelines or pipeline segments, a conveyor gallery, sluices, and other generally elongated structures intended to be ultimately placed in a generally horizontal position. Further, although structures described herein have generally been described as being either concrete or composite concrete/steel structures, the method of lower the structures from an essentially vertical position to a generally horizontal position are equally applicable to structures formed primarily from steel or other materials of construction. Additionally, while I have generally described the methods of forming the structures in the essentially vertical position as including continuous (slip forming) and semi-continuous (jump forming) processes, the structures can also be modularly constructed in the essentially vertical position by placing precast modules on top of one another using a crane or the like, and joining the modules together to produce the essentially vertical overall structure.

Yet another embodiment of the present invention provides for a method of placing a concrete structure (such as structure 100 of FIGS. 1 though 5, structure 200 of FIGS. 6 through 9 and FIGS. 13 through 19, structures 250 and 250 of FIG. 10, and structures 270 and 272 of FIG. 11) in a generally horizontal position. The method includes building the concrete structure in an essentially vertical position. In all cases, the structure is defined by a first end which is vertically lower than an opposing second end of the structure. The method further includes pivotably supporting the concrete structure at a support location (e.g., support location 1 of FIGS. 1, 2, 3, 6, 7, 9, 10, 14, and 16-19, and support location 3 of FIGS. 10, and 1A and 1B of FIG. 11) proximate the first end of the structure while the concrete structure is in the essentially vertical position. Preferably, the structure is pivotably supported at the support location so as to prevent significant horizontal translational movement of the structure at the support location. By "significant horizontal translational movement" I mean that the first end of the structure is constrained to less potential horizontal movement than is the opposing second end of the structure. The method further includes pivoting or rotating the concrete structure about the support location to move the concrete structure from the essentially vertical position to the generally horizontal position. The concrete structure can be defined by a second end (the uppermost end, such as end 101 of structure 100 of FIG. 2, or end 203 of structure 200 of FIG. 6) which is distal from the first end. The method can thus further include supporting the concrete structure at the second end (i.e., the end distal from the support location) after the structure has been pivoted into the generally horizontal position.

The method can further include applying post-tensioning tendons to the concrete structure while it is in the essentially vertical position. This can be accomplished using the post tensioning ducts 208 of FIG. 13, for example. In another variation, the method can include removably attaching a counterweight (e.g., counterweight 20 of FIGS. 1 and 2) to the first end (i.e., the lowermost end) of the structure while the structure is in the essentially vertical position. The method can then include removing the counterweight from the first end of the concrete structure after the concrete structure has been pivoted into the generally horizontal position.

As can be seen in FIGS. 6 and 9, the method can further include providing a first support (e.g., support 53) and a second support (e.g., support 55), and the concrete structure (200, in the case of FIGS. 6 and 9) is pivotably supported at the support location (1, FIGS. 6 and 9) by the first support (e.g., 53), and is supported at the second end (203, for example) end by the second support (55, for example). Further, as depicted in FIGS. 4 and 5, the concrete structure (100, in this example) can be defined by a second end 101 which is distal from the first end 103, and the method can further include providing a cantilevered second concrete structure (100A) defined by a free end (101A), and connecting the concrete structure (100) at the second end (101) to the free end (101A) of the cantilevered second concrete structure (100A) after the concrete structure (100) has been pivoted into the generally horizontal position.

As mentioned previously, the method can further include providing a first support, (e.g., support 14 of FIG. 2, or support 53 of FIG. 6), and the concrete structure (100, FIG. 2, or 200, FIG. 6) is pivotably supported at the support location (1) by the first support. In this instance the method can additionally include providing pivot piers (e.g., 18, FIGS. 1 and 2, or 58 and 60, FIG. 7) supported on the first support (1, FIGS. 1, 2, 6 and 7) located proximate the opposing sides of the concrete structure (e.g., structure 100 of FIGS. 1 and 2, or structure 200 of FIGS. 6 and 7), and the concrete structure can be pivotably supported at the support location by the pivot piers.

As depicted in FIGS. 4 and 5, the method can also include removably attaching a counterweight (20) to the first end (103) of the concrete structure (100) while the concrete structure is in the essentially vertical position, and placing at least one spacer (16, FIGS. 1 and 2) between the counterweight and the first support while the concrete structure is in the essentially vertical position. The method can then include removing the at least one spacer (16, FIGS. 1 and 2) from between the counterweight (20) and the first support (14) prior to pivoting the concrete structure (100) to the generally horizontal position (as depicted in FIG. 5). As depicted in FIG. 4, the method also provides for applying a torsional force about the support location (1) to cause the concrete structure (100) to pivot from the essentially vertical position (FIG. 4) to the generally horizontal position (FIG. 5). Further, the torsional force can be applied about the support location (1) by applying an initial shear force to the second end (101) of the concrete structure (100).

A further embodiment of the present invention provides for a method of placing a concrete structure in a generally horizontal position. The method includes providing a first support (e.g., support 53, FIGS. 14 through 19) and a second support (e.g., support 55, FIGS. 14-19), and providing a concrete structure (e.g., structure 200, FIGS. 17-19). The concrete structure (e.g., 200) is defined by a structure first end (proximate first support location 1) and an opposite structure second end (proximate the yoke cap 336, FIGS. 17-19). The method further includes pivotably supporting the concrete structure on the first support proximate the structure first end and in an essentially vertical position, and providing a boom (e.g., boom 322, FIGS. 14 through 17) which is defined by a boom first end (at the hinge connection 324, FIG. 14) and a boom second end (proximate the lowering jack 328, FIG. 14). The method also includes pivotably supporting the boom first end (proximate hinge 324, and via hinge 324) on the second support (55), and moveably connecting the boom second end (proximate lowering jack 328) to the concrete structure (200, and including the evolving concrete structure 200) proximate the structure second end (proximate the lowering jack 328, and distal from the first support location 1). The method then includes moving the structure second end (proximate the lowering jack 328) along the boom (322) towards the second support (55) until the concrete structure (200) is in the generally horizontal position (per FIG. 19). As indicated in FIGS. 14 through 19, the boom 322 can be provided as a plurality of detachable boom segments 330 which are connected to one another to form the boom. In this instance the method can further include detaching boom segments 330 (FIG. 18) that are not located between the boom first end (beyond lowering jack 328) and the structure second end (at the lowering jack 328) as the structure second end (proximate the lowering jack) is moved along the boom (322) towards the second support 55).

I claim:

1. Apparatus for forming a concrete structure in an essentially vertical position and lowering the concrete structure to a generally horizontal position, the apparatus comprising:

a structure forming apparatus comprising:

a yoke configured to move upward along a climb rod to form the concrete structure in the essentially vertical position on a first support;

concrete forms configured to form the concrete structure in at least one of a jump-from mode or a slip-form mode;

a plurality of truss modules moveably supporting the concrete forms by the yoke; and a structure lowering apparatus comprising:

a boom defined by a boom first end and a boom second end, the boom configured to be pivotably supported at the boom first end by a second support which is distal form the first support; and a lowering jack which engages and is configured to move along the boom, and which is configured to be pivotably attached to the yoke of the structure forming apparatus.

2. The apparatus of claim 1, and wherein the boom comprises a plurality of detachable boom segments which are connectable to one another to form the boom.

3. The apparatus of claim 2, and further comprising a crane supported on the lowering jack.

4. The apparatus of claim 1, and wherein the structure forming apparatus further comprises an attitude control module connected to the yoke and configured to engage the concrete structure to guide the forms along the climb rod.

5. The apparatus of claim 1, and wherein the structure forming apparatus further comprises an attitude control module connected to at least one of the truss modules and configured to engage the concrete structure to guide the forms along the climb rod.

* * * * *